US008821254B2

(12) United States Patent
Tsukahara

(10) Patent No.: US 8,821,254 B2
(45) Date of Patent: Sep. 2, 2014

(54) GAMING MACHINE HAVING EFFECT CORRESPONDING TO AWARD TO BE PROVIDED FOR SPECIAL GAME AND PLAYING METHOD THEREOF

(75) Inventor: Nakayasu Tsukahara, Koto-ku (JP)

(73) Assignee: Universal Entertainment Corporation, Tokyo (JP)

( * ) Notice: Subject to any disclaimer, the term of this patent is extended or adjusted under 35 U.S.C. 154(b) by 1007 days.

(21) Appl. No.: 12/183,531

(22) Filed: Jul. 31, 2008

(65) Prior Publication Data

US 2009/0239613 A1 Sep. 24, 2009

Related U.S. Application Data

(60) Provisional application No. 61/038,849, filed on Mar. 24, 2008.

(51) Int. Cl.
*G07F 17/34* (2006.01)
*G07F 17/32* (2006.01)

(52) U.S. Cl.
CPC ..... *G07F 17/34* (2013.01); *G07F 17/3227* (2013.01)
USPC ..... 463/25

(58) Field of Classification Search
CPC .. G07C 15/00; G07C 15/006; G07F 17/3213; G07F 17/329; G07F 17/3244; G07F 17/3267; G07F 17/3227; G07F 17/34; A63F 2003/088; A63F 3/0645; A63F 3/08; A63F 3/081; A63F 3/0605; A63F 2003/082; A63F 2300/6036
USPC ..... 463/16, 20, 30, 31, 17–19, 11–13, 25, 463/26–28, 35–39, 40, 41, 42, 2–10
See application file for complete search history.

(56) References Cited

U.S. PATENT DOCUMENTS 4,283,709 A 8/1981 Lucero et al.
4,624,459 A 11/1986 Kaufman
(Continued)

FOREIGN PATENT DOCUMENTS

DE 32 42 890 A1 5/1984
DE 37 12 841 A1 11/1988
(Continued)

OTHER PUBLICATIONS

U.S. Appl. No. 12/469,464, filed May 20, 2009, Tsukahara.
(Continued)

*Primary Examiner* — David L Lewis
*Assistant Examiner* — Matthew D Hoel
(74) *Attorney, Agent, or Firm* — Lexyoume IP Meister, PLLC

(57) ABSTRACT

In a gaming machine, a unit game causing arranged symbols to be rearranged is displayed on a display. When a predetermined condition is satisfied, a special game including a predetermined number of the unit games is displayed on the display. Additionally, a total amount of payout to be provided to a player when the special game is executed, a symbol rearrangement pattern in the predetermined number of unit games for providing the total amount of payout, and contents of an effect corresponding to the total amount of payout to be provided to the player are determined before start of the special game. Moreover, the contents of the effect previously determined and the predetermined number of unit games according to the symbol rearrangement pattern previously determined are displayed on the display during the special game. Furthermore, after the special game including the predetermined number of unit games is executed, the total amount of payout previously determined are provided to the player.

20 Claims, 19 Drawing Sheets

(56) References Cited

U.S. PATENT DOCUMENTS

| | | | | |
|---|---|---|---|---|
| 4,669,731 | A | 6/1987 | Clarke | |
| 4,837,728 | A | 6/1989 | Barrie et al. | |
| 4,964,638 | A | 10/1990 | Ishida | |
| 5,280,909 | A | 1/1994 | Tracy | |
| 5,324,035 | A * | 6/1994 | Morris et al. | 463/42 |
| 5,564,700 | A | 10/1996 | Celona | |
| 5,611,730 | A | 3/1997 | Weiss | |
| 5,639,088 | A | 6/1997 | Schneider et al. | |
| 5,695,402 | A | 12/1997 | Stupak | |
| 5,702,303 | A | 12/1997 | Takemoto et al. | |
| 5,770,533 | A | 6/1998 | Franchi | |
| 5,820,459 | A | 10/1998 | Acres et al. | |
| 5,836,817 | A | 11/1998 | Acres et al. | |
| 5,890,963 | A | 4/1999 | Yen | |
| 5,910,048 | A | 6/1999 | Feinberg | |
| 5,934,672 | A * | 8/1999 | Sines et al. | 273/143 R |
| 6,001,016 | A | 12/1999 | Walker et al. | |
| 6,003,013 | A | 12/1999 | Boushy et al. | |
| 6,056,642 | A * | 5/2000 | Bennett | 463/20 |
| 6,089,977 | A * | 7/2000 | Bennett | 463/20 |
| 6,089,980 | A | 7/2000 | Gauselmann | |
| 6,142,874 | A * | 11/2000 | Kodachi et al. | 463/20 |
| 6,142,875 | A * | 11/2000 | Kodachi et al. | 463/20 |
| 6,206,781 | B1 * | 3/2001 | Sunaga et al. | 463/20 |
| 6,224,482 | B1 | 5/2001 | Bennett | |
| 6,234,896 | B1 | 5/2001 | Walker et al. | |
| 6,244,957 | B1 | 6/2001 | Walker et al. | |
| 6,254,483 | B1 | 7/2001 | Acres | |
| 6,257,981 | B1 | 7/2001 | Acres et al. | |
| 6,270,409 | B1 | 8/2001 | Shuster | |
| 6,273,820 | B1 | 8/2001 | Haste, III | |
| 6,290,600 | B1 * | 9/2001 | Glasson | 463/20 |
| 6,311,976 | B1 * | 11/2001 | Yoseloff et al. | 273/138.2 |
| 6,319,124 | B1 * | 11/2001 | Baerlocher et al. | 463/20 |
| 6,375,570 | B1 * | 4/2002 | Poole | 463/31 |
| 6,398,217 | B1 * | 6/2002 | Shimizu et al. | 273/121 B |
| 6,419,579 | B1 * | 7/2002 | Bennett | 463/20 |
| 6,497,617 | B1 * | 12/2002 | Yoshida | 463/20 |
| 6,517,433 | B2 * | 2/2003 | Loose et al. | 463/20 |
| 6,582,306 | B1 * | 6/2003 | Kaminkow | 463/20 |
| 6,599,193 | B2 * | 7/2003 | Baerlocher et al. | 463/27 |
| 6,605,002 | B2 * | 8/2003 | Baerlocher | 463/25 |
| 6,659,867 | B1 * | 12/2003 | Kodachi et al. | 463/20 |
| 6,692,356 | B2 * | 2/2004 | Baerlocher et al. | 463/20 |
| 6,695,697 | B1 | 2/2004 | Okada | |
| 6,702,675 | B2 * | 3/2004 | Poole et al. | 463/31 |
| 6,811,485 | B2 * | 11/2004 | Kaminkow | 463/20 |
| 6,832,959 | B2 * | 12/2004 | Baerlocher | 463/25 |
| 6,932,704 | B2 | 8/2005 | Walker et al. | |
| 6,932,707 | B2 | 8/2005 | Duhamel | |
| 7,115,033 | B1 * | 10/2006 | Timperley | 463/20 |
| 7,361,088 | B2 * | 4/2008 | Maya et al. | 463/20 |
| 7,980,936 | B2 * | 7/2011 | Mead | 463/16 |
| 8,360,846 | B1 * | 1/2013 | Bennett et al. | 463/20 |
| 8,574,058 | B2 * | 11/2013 | Schultz et al. | 463/20 |
| 2001/0049298 | A1 * | 12/2001 | Bennett | 463/16 |
| 2002/0010017 | A1 * | 1/2002 | Bennett | 463/20 |
| 2002/0016201 | A1 * | 2/2002 | Bennett et al. | 463/25 |
| 2002/0025849 | A1 * | 2/2002 | Olive | 463/29 |
| 2002/0082074 | A1 * | 6/2002 | Bennett | 463/20 |
| 2002/0119814 | A1 * | 8/2002 | Fong et al. | 463/13 |
| 2003/0054877 | A1 * | 3/2003 | Baerlocher | 463/25 |
| 2003/0069073 | A1 | 4/2003 | Okada | |
| 2003/0190947 | A1 * | 10/2003 | Baerlocher et al. | 463/20 |
| 2003/0190948 | A1 * | 10/2003 | Baerlocher et al. | 463/20 |
| 2003/0199310 | A1 * | 10/2003 | Kaminkow | 463/20 |
| 2003/0211880 | A1 * | 11/2003 | Locke | 463/20 |
| 2004/0014518 | A1 * | 1/2004 | Iwamoto | 463/20 |
| 2004/0038730 | A1 * | 2/2004 | Suda | 463/20 |
| 2004/0171422 | A1 * | 9/2004 | Baerlocher | 463/25 |
| 2005/0059459 | A1 * | 3/2005 | Dunn et al. | 463/16 |
| 2005/0101377 | A1 * | 5/2005 | Baerlocher | 463/25 |

FOREIGN PATENT DOCUMENTS

| | | | | |
|---|---|---|---|---|
| DE | 41 37 010 | A1 | 8/1992 | |
| DE | 100 49 444 | A1 | 11/2001 | |
| EP | 0 631 798 | A1 | 1/1995 | |
| EP | 0 840 264 | A1 | 5/1998 | |
| EP | 0 945 837 | A2 * | 9/1999 | G07F 17/32 |
| EP | 1 192 975 | A1 | 4/2002 | |
| EP | 1 302 914 | A2 | 4/2003 | |
| EP | 1 351 180 | A2 | 10/2003 | |
| EP | 1 477 947 | A2 | 11/2004 | |
| EP | 1 544 811 | A2 | 6/2005 | |
| GB | 2 326 830 | | 1/1999 | |
| WO | WO 03/083795 | A1 | 10/2003 | |
| WO | WO 2004/095383 | A1 | 11/2004 | |

OTHER PUBLICATIONS

U.S. Appl. No. 12/403,973, filed Mar. 13, 2009, Tsukahara.

U.S. Appl. No. 12/480,272, filed Jun. 8, 2009, Tsukahara.

* cited by examiner

| | COLUMN1 | COLUMN2 | COLUMN3 | COLUMN4 | COLUMN5 |
|---|---|---|---|---|---|
| ROW1 | q11 | q21 | q31 | q41 | q51 |
| ROW2 | q12 | q22 | q32 | q42 | q52 |
| ROW3 | q13 | q23 | q33 | q43 | q53 |

FIG. 13

| TOTAL NUMBER OF PAYOUTS | CONTENTS OF EFFECT SCREEN |
|---|---|
| 100 CREDITS OR BELOW | ANGEL WITH WINGS FOLDED |
| ABOVE 100 CREDITS | ANGEL WITH WINGS SPREAD |

GAMING MACHINE HAVING EFFECT CORRESPONDING TO AWARD TO BE PROVIDED FOR SPECIAL GAME AND PLAYING METHOD THEREOF

CROSS REFERENCE TO RELATED APPLICATIONS

This application claims priority to U.S. provisional patent application Ser. No. 61/038,849 filed on Mar. 24, 2008, and which is incorporated by reference herein for all purposes.

BACKGROUND OF THE INVENTION

1. Field of the Invention

The present invention relates to a gaming machine having an effect corresponding to an award to be provided for a special game and a playing method thereof.

2. Description of the Related Art

As described in U.S. Pat. No. 5,820,459 specification, U.S. Pat. No. 6,695,697 specification, U.S. Patent Application Publication No. 2003/0,069,073 specification, European Patent Application Publication No. 1,192,975 specification, U.S. Pat. No. 6,254,483 specification, U.S. Pat. No. 5,611,730 specification, U.S. Pat. No. 5,639,088 specification, U.S. Pat. No. 6,257,981 specification, U.S. Pat. No. 6,234,896 specification, U.S. Pat. No. 6,001,016 specification, U.S. Pat. No. 6,273,820 specification, U.S. Pat. No. 6,224,482 specification, U.S. Pat. No. 4,669,731 specification, U.S. Pat. No. 6,244,957 specification, U.S. Pat. No. 5,910,048 specification, U.S. Pat. No. 5,695,402 specification, U.S. Pat. No. 6,003,013 specification, U.S. Pat. No. 4,283,709 specification, European Patent Application Publication No. 0,631,798 specification, German Patent Application Publication No. 4,137,010 specification, British Patent Application Publication No. 2,326,830 specification, German Patent Application Publication No. 3,712,841 specification, U.S. Pat. No. 4,964,638 specification, U.S. Pat. No. 6,089,980 specification, U.S. Pat. No. 5,280,909 specification, U.S. Pat. No. 5,702,303 specification, U.S. Pat. No. 6,270,409 specification, U.S. Pat. No. 5,770,533 specification, U.S. Pat. No. 5,836,817 specification, U.S. Pat. No. 6,932,704 specification, U.S. Pat. No. 6,932,707 specification, U.S. Pat. No. 4,837,728 specification, European Patent Application Publication No. 1,302,914 specification, U.S. Pat. No. 4,624,459 specification, U.S. Pat. No. 5,564,700 specification, PCT Patent Application Publication No. 03/083,795 specification, German Patent Application Publication No. 3,242,890 specification, European Patent Application Publication No. 0,840,264 specification, German Patent Application Publication No. 10,049,444 specification, PCT Patent Application Publication No. 04/095,383 specification, European Patent Application Publication No. 1,544,811 specification, U.S. Pat. No. 5,890,963 specification, European Patent Application Publication No. 1,477,947 specification, and European Patent Application Publication No. 1,351,180 specification, in a facility in which gaming machines such as slot machines are provided, a player can play a game provided by a gaming machine by making bets such as coins, credits, etc., at that gaming machine.

For example, the slot machine executes a slot game in which a plurality of symbols arranged on a display are rearranged every time a player makes bets and presses a start switch at the slot machine. Then, I the case where the symbols rearranged on a display contain a prescribed number of scatter symbols or a prescribed winning combination is realized on a payline, the slot machine makes a payout according to that content.

Furthermore, in a gaming machine typified by the slot machine described above, a special game is executed when predetermined conditions are satisfied. In many cases, the special game is a slot game that can be executed without making a bet, in other words, a free game, and is also called a feature game. In the special game typified by the free game, there is a chance to get a large payout. At the same time, the chance to get a large payout is just a probability. Thus, there is no guarantee that a large payout can always be provided in the special game.

Therefore, a provider who provides the player with games played with the gaming machine wishes to promote the special game as a chance to get a large payout to the player. However, it is a reality that the provider hesitates to make such an appeal since a large payout cannot be guaranteed to be provided to the player.

SUMMARY OF THE INVENTION

It is an object of the present invention to provide a gaming machine with improved entertainment properties, which allows a special game typified by a free game to properly appeal to a player, and a playing method thereof A first aspect of the present invention is a gaming machine comprising: a display configured to display a unit game causing a plurality of arranged symbols to be rearranged, and to display a special game and an effect upon satisfaction of a predetermined condition, the special game including a predetermined number of the unit games to be executed; and a controller configured to (a) determine a total amount of an award to be provided to a player in the special game by lottery prior to start of the special game upon satisfaction of the predetermined condition, (b) determine a symbol rearrangement pattern for generating, during the special game, the determined total amount of the award for each of the predetermined number of the unit games prior to the start of the special game, and (c) determine contents of the effect to be displayed on the display during the special game, according to the determined total amount of the award prior to the start of the special game.

A second aspect of the present invention is a gaming machine comprising: a display configured to display a unit game causing a plurality of arranged symbols to be rearranged, and to display a special game and an effect upon satisfaction of a predetermined condition, the special game including a predetermined number of the unit games to be executed; a memory configured to store a table associating a total amount of an award to be provided to a player in the special game with contents of the effect to be displayed on the display during the special game; and a controller configured to (a) determine a total amount of an award to be provided to a player in the special game by lottery prior to start of the special game upon satisfaction of the predetermined condition, (b) determine a symbol rearrangement pattern for generating, during the special game, the determined total amount of the award for each of the predetermined number of the unit games prior to the start of the special game, and (c) determine contents of an effect associated with the determined total amount of the award in the table as the contents of the effect to be displayed on the display during the special game.

A third aspect of the present invention is a gaming machine comprising: a display configured to display a unit game causing a plurality of arranged symbols to be rearranged, and to display a special game and an effect upon satisfaction of a predetermined condition, the special game including a predetermined number of the unit games to be executed; and a controller configured to (a) determine a symbol rearrangement pattern for each of the predetermined number of the unit games to be displayed on the display as the special game, prior to start of the special game upon satisfaction of the predetermined condition, and (b) determine contents of the effect to be displayed on the display during the special game prior to the start of the special game, in accordance with a total amount of an award to be generated for the determined symbol rearrangement pattern during the special game.

A fourth aspect of the present invention is a method for playing a gaming machine configured to display a unit game causing a plurality of arranged symbols to be rearranged on a display and to display a special game and an effect on the display upon satisfaction of a predetermined condition, the special game including a predetermined number of the unit games to be executed, the method comprising: determining a total amount of an award to be provided to a player in the special game by lottery prior to start of the special game upon satisfaction of the predetermined condition; determining a symbol rearrangement pattern for generating, during the special game, the determined total amount of the award for each of the predetermined number of the unit games prior to the start of the special game; and determining contents of the effect to be displayed on the display during the special game, according to the determined total amount of the award prior to the start of the special game.

A fifth aspect of the present invention is a method for playing a gaming machine configured to display a unit game causing a plurality of arranged symbols to be rearranged on a display and to display a special game and an effect on the display upon satisfaction of a predetermined condition, the special game including a predetermined number of the unit games to be executed, the method comprising: determining a total amount of an award to be provided to a player in the special game by lottery prior to start of the special game upon satisfaction of the predetermined condition; determining a symbol rearrangement pattern for generating, during the special game, the determined total amount of the award for each of the predetermined number of the unit games prior to the start of the special game; and determining contents of an effect associated with the determined total amount of the award in a table as the contents of the effect to be displayed on the display during the special game, the table associating the total amount of the award to be provided to the player in the special game with contents of the effect to be displayed on the display during the special game.

A sixth aspect of the present invention is a method for playing a gaming machine configured to display a unit game causing a plurality of arranged symbols to be rearranged on a display and to display a special game and an effect on the display upon satisfaction of a predetermined condition, the special game including a predetermined number of the unit games to be executed, the method comprising: determining a symbol rearrangement pattern for each of the predetermined number of the unit games to be displayed on the display as the special game, prior to start of the special game upon satisfaction of the predetermined condition, and determining contents of the effect to be displayed on the display during the special game prior to the start of the special game, in accordance with a total amount of an award to be generated when the predetermined number of unit games are displayed on the display along with the determined symbol rearrangement pattern during the special game.

BRIEF DESCRIPTION OF THE DRAWINGS

FIG. 13 is an explanatory view showing a correspondence table stored in an external storage device in the slot machine according to the first embodiment of the present invention.

DETAILED DESCRIPTION OF THE EMBODIMENT

With reference to FIGS. 1A to 9, general description will be given below of operations and a playing method of a slot machine that is an example of a gaming machine according to the present invention.

Figure 1A:
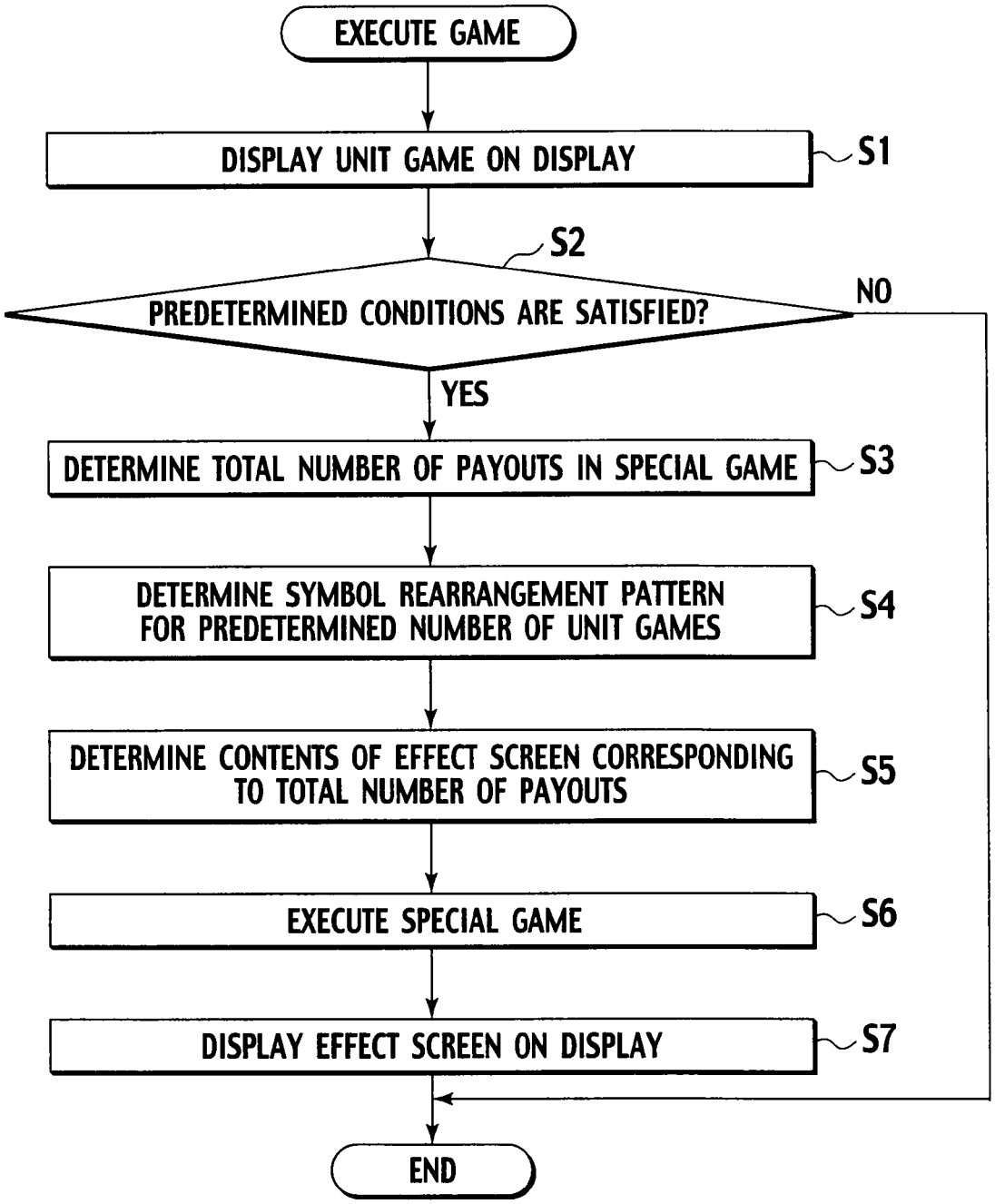
FIG. 1A is a flowchart schematically showing a slot machine and a playing method thereof according to first, third and fourth embodiments, which is an example of a gaming machine of the present invention.
Figure 1B:
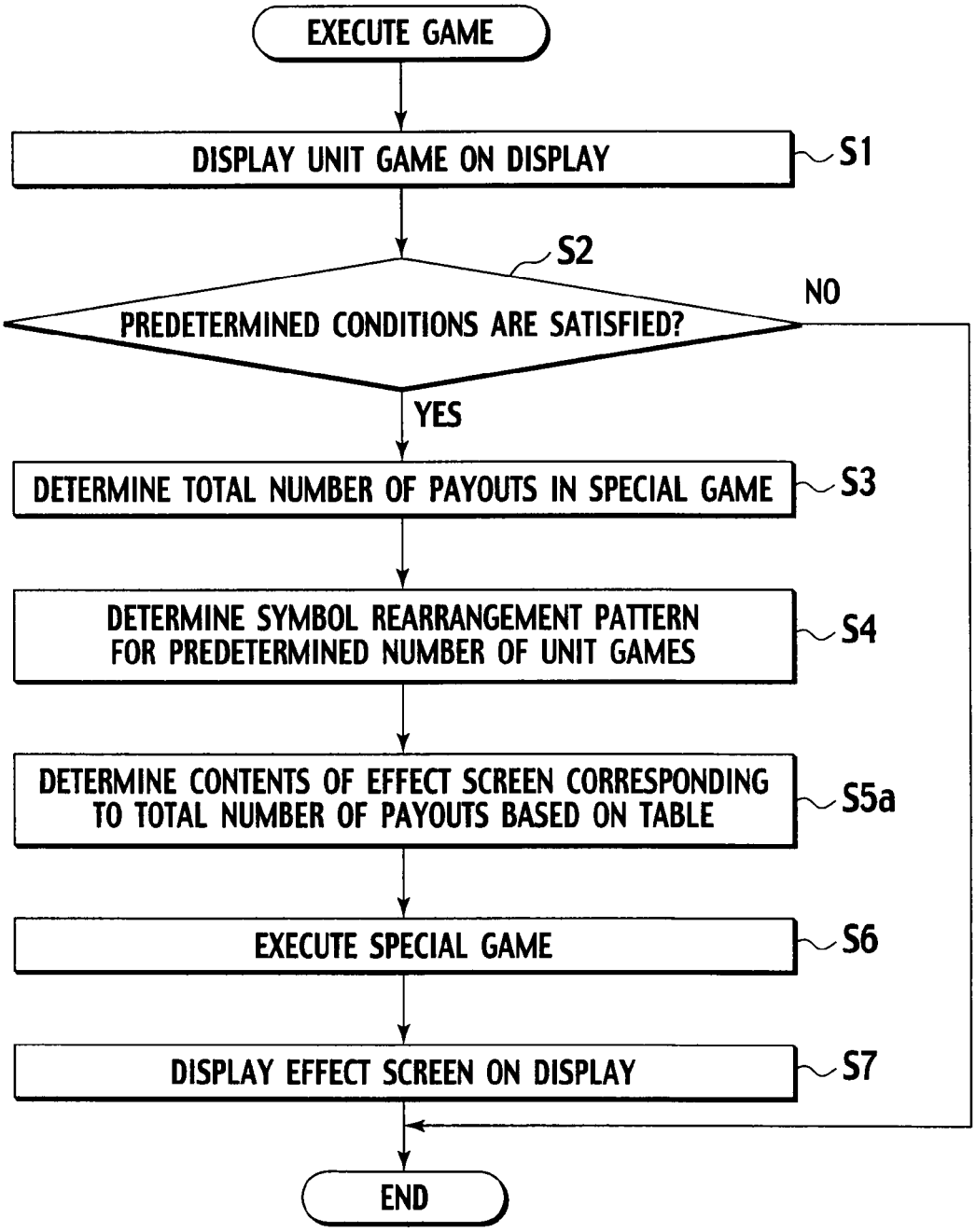
FIG. 1B is a flowchart schematically showing a slot machine and a playing method thereof according to the first, third and fourth embodiments, which is another example of the gaming machine of the present invention.
Figure 1C:
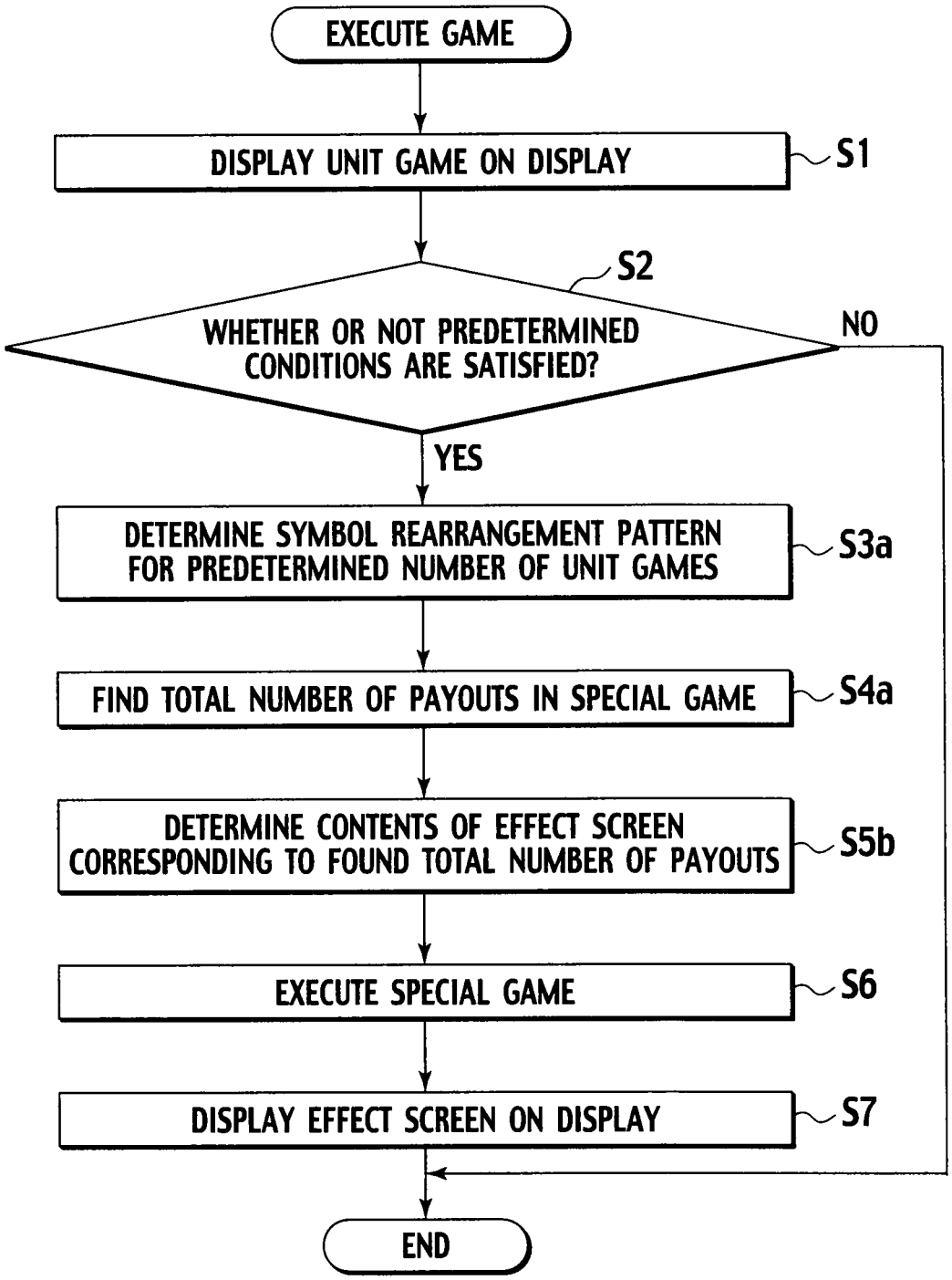
FIG. 1C is a flowchart schematically showing a slot machine and a playing method thereof according to a second embodiment, which is still another example of the gaming machine of the present invention.
Figures 2, 3:
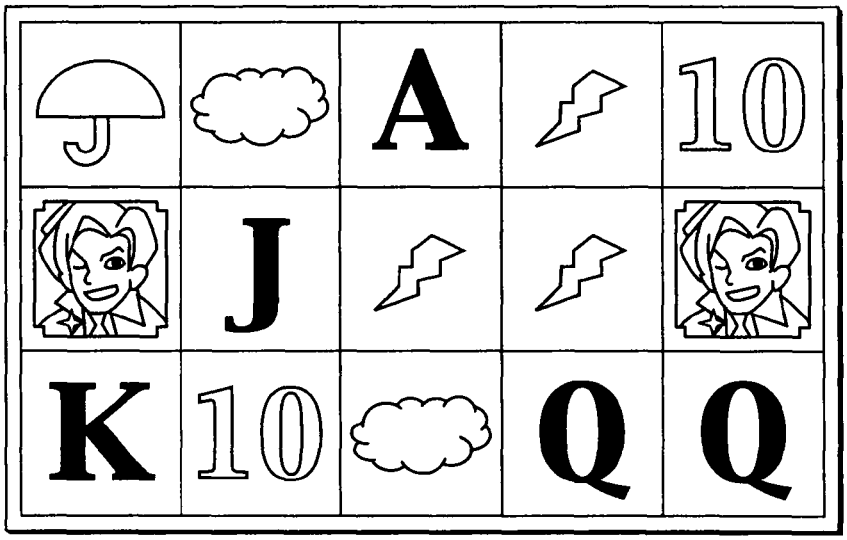
FIG. 2 is an explanatory view showing a display example displayed on a display in the slot machine according to the first embodiment of the present invention.
FIG. 3 is an explanatory view showing partitioned regions in a matrix pattern provided on the display in the slot machine according to the first embodiment of the present invention.
Figure 4:
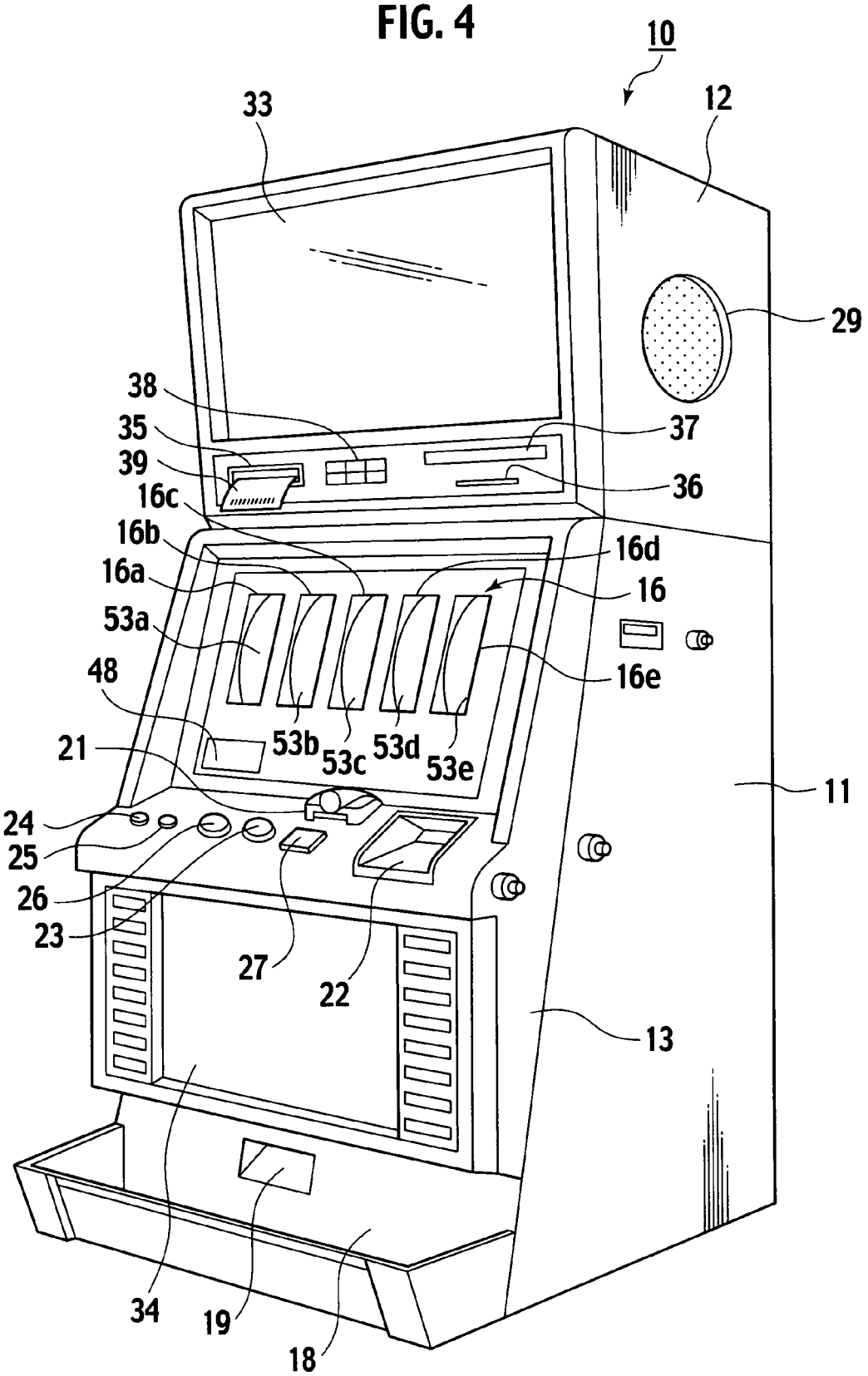
FIG. 4 is a perspective view of the slot machine according to the first embodiment of the present invention.
Figure 5:
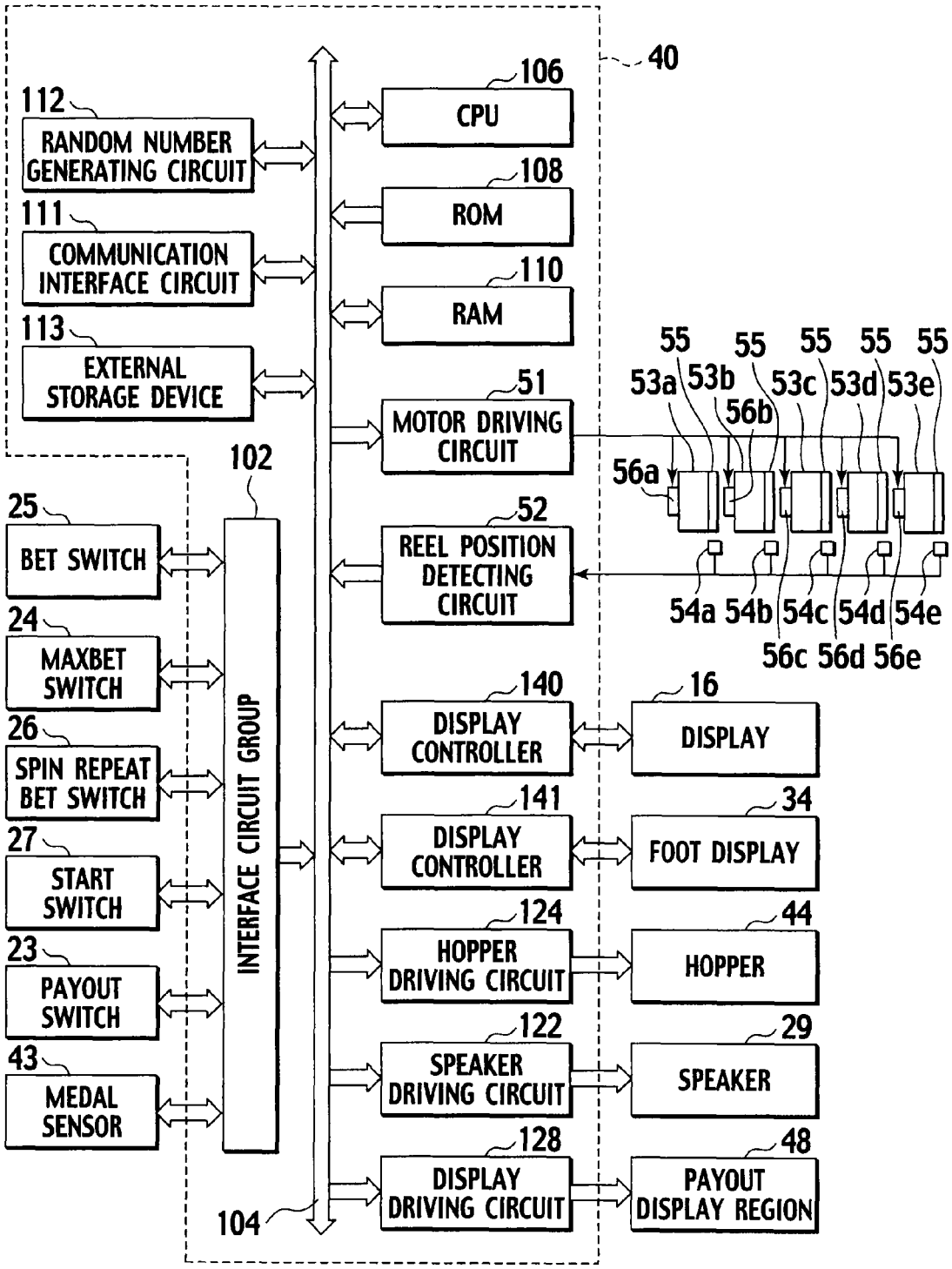
FIG. 5 is a block diagram showing a control circuit in the slot machine according to the first embodiment of the present invention.
Figure 6A:
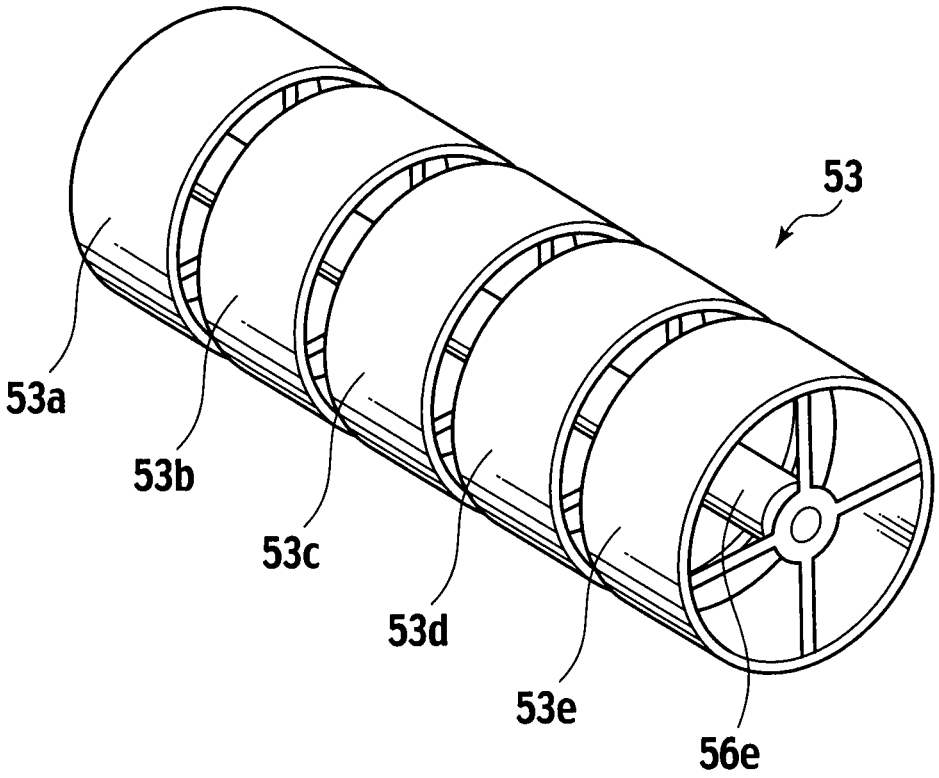
FIG. 6A is a perspective view showing a rotating reel device in the slot machine according to the first embodiment of the present invention.
Figure 6B:
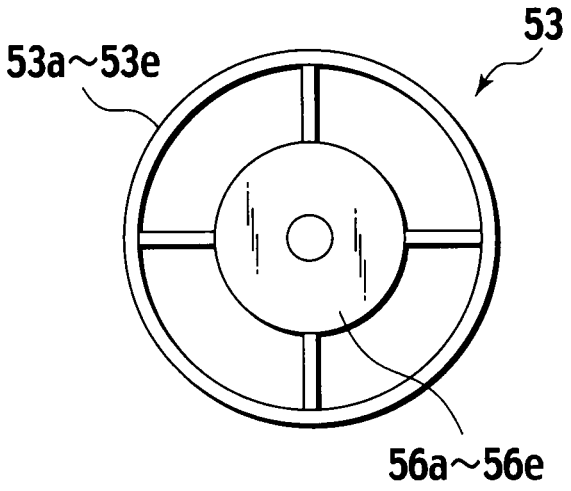
FIG. 6B is a side view showing the rotating reel device in the slot machine according to the first embodiment of the present invention.
Figure 7:
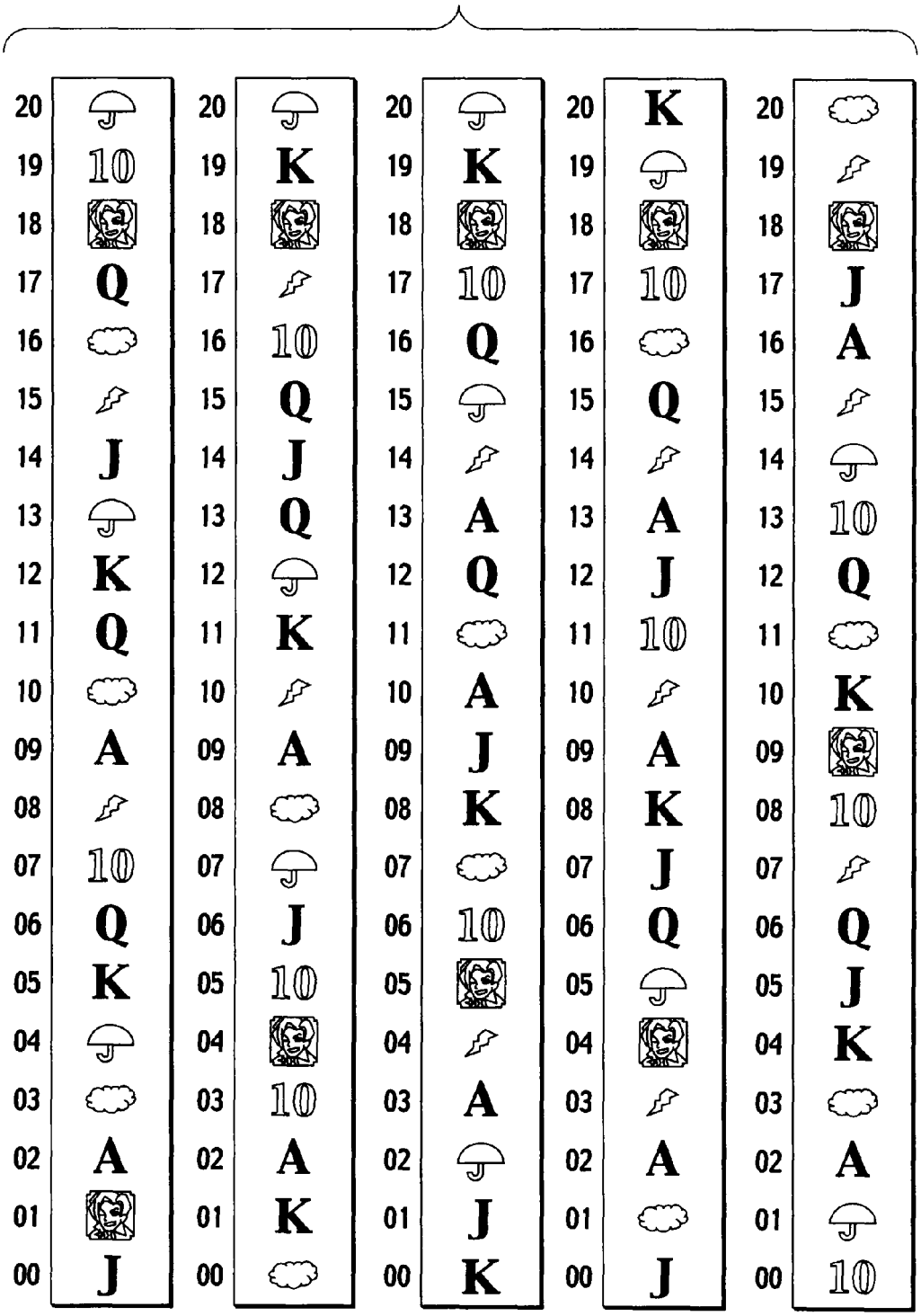
FIG. 7 is an explanatory view showing schematic configurations of symbols arranged on circumferential surfaces of rotating reels in the slot machine according to the first embodiment of the present invention.
Figure 8:
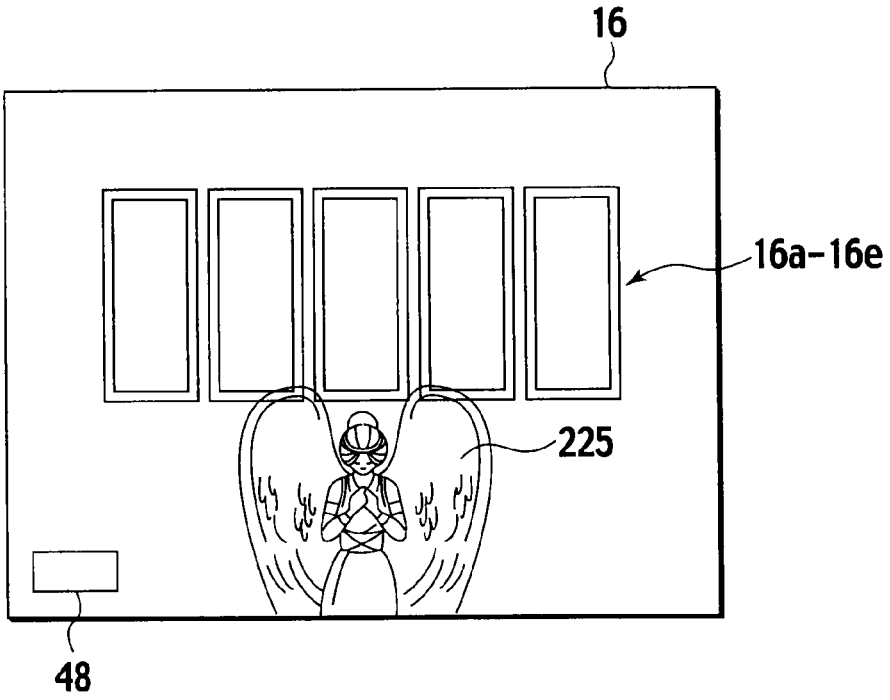
FIG. 8 is an explanatory view showing a display example displayed on the display in the slot machine according to the first embodiment of the present invention.
Figure 9:
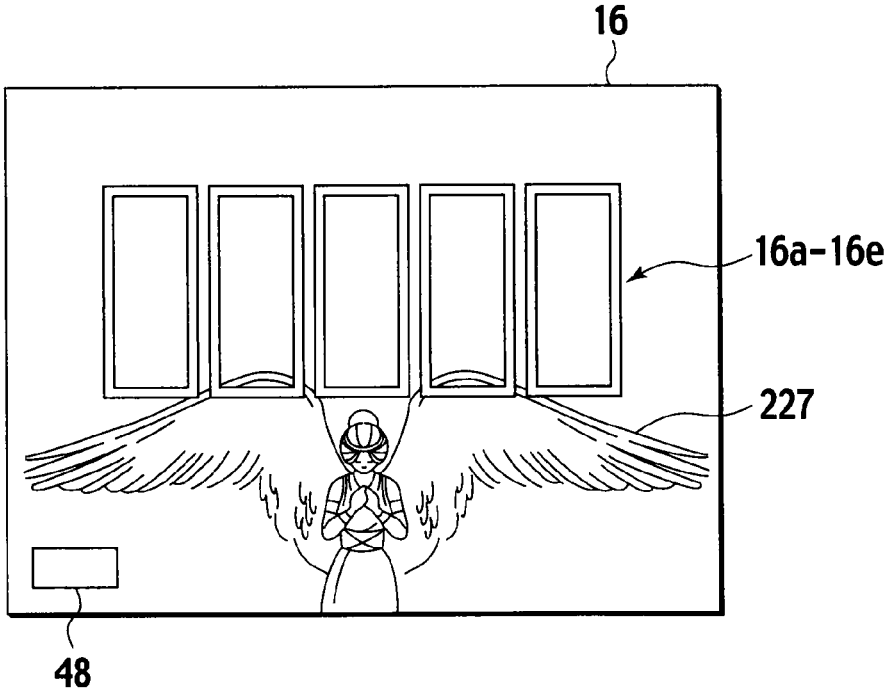
FIG. 9 is an explanatory view showing a display example displayed on the display in the slot machine according to the first embodiment of the present invention.

FIGS. 1A to 1C are flowcharts schematically showing a slot machine and a playing method thereof according to first to fourth embodiments, that is an example of the gaming machine of the present invention. FIG. 2 is an explanatory view showing a display example displayed on a display in the slot machine according to the first embodiment of the present invention. FIG. 3 is an explanatory view showing partitioned regions in a matrix pattern provided on the display in the slot machine according to the first embodiment of the present invention. FIG. 4 is a perspective view of the slot machine according to the first embodiment of the present invention. FIG. 5 is a block diagram showing a control circuit in the slot machine according to the first embodiment of the present invention. FIG. 6A is a perspective view showing a rotating reel device in the slot machine according to the first embodiment of the present invention. FIG. 6B is a side view showing the rotating reel device in the slot machine according to the first embodiment of the present invention. FIG. 7 is an explanatory view showing schematic configurations of symbols arranged on circumferential surfaces of rotating reels in the slot machine according to the first embodiment of the present invention. FIG. 8 is an explanatory view showing a display example displayed on the display in the slot machine according to the first embodiment of the present invention. FIG. 9 is an explanatory view showing a display example displayed on the display in the slot machine according to the first embodiment of the present invention.

On a front surface of a cabinet 11 of a slot machine 10 shown in FIG. 4, a display 16 (a first display) is provided. The display 16 has fifteen partitioned regions q11 to q53 as shown in FIG. 3. These partitioned regions q11 to q53 are arranged in a matrix pattern including first to fifth columns and first to third rows.

In the slot machine 10 shown in FIG. 4 according to an example of the present invention, every time a unit game is played, symbols arranged as shown in FIG. 2 are rearranged, respectively, in the partitioned regions q11 to q53 shown in FIG. 3 described above. The unit game can be executed by rotating and stopping rotating reels 53*a* to 53*e* behind display regions q11 to q53 of the display 16, for example.

As shown in FIGS. 6A and 6B, a rotating reel device 53 has five rotating reels 53*a* to 53*e* corresponding to windows 16*a* to 16*e* in the display 16, respectively. On a circumferential surface of each of the rotating reels 53*a* to 53*e*, as shown in FIG. 7, twenty-one symbols are laid out so as to be equally spaced apart. There are nine kinds of symbols, including "A (ace)", "K (king)", "Q (queen)", "J (jack)", "10", "umbrella", "lightning", "cloud" and "special (man's face)".

Five of the symbols on the respective rotating reels 53*a* to 53*e* are visible to a player through the corresponding display regions q11 to q53. Thus, arrangement and rearrangement of the symbols are executed by rotating and stopping the rotating reels 53*a* to 53*e*.

When the symbols are rearranged in each of the partitioned regions q11 to q53 in the unit game, the number of credits to be paid out (an amount of awards to be provided) is determined according to rules of a predetermined payout table. Thereafter, a payout equivalent to the determined number of credits is provided. Subsequently, the symbols in the respective partitioned regions q11 to q53 are rearranged as the next unit game is started.

As shown in FIG. 1A, the slot machine 10 shown in FIG. 4 according to the example of the present invention displays such a unit game, in which the multiple arranged symbols are rearranged as described above, on a display that can be formed by including the display 16 shown in FIG. 4 (Step S1).

The unit game can be executed by the player betting a wager. To be more specific, the wager can be bet by inserting medals or coins as cashable credits, which can be cashed in, into the slot machine 10 by the player. Alternatively, the wager can also be bet by allocating restricted credits for an amount specified by the player to the wager by the player operating the slot machine 10. Specifically, the restricted credits are digitized and stored in the slot machine 10, and can be continuously used as the wager until the restricted credits are cashed in.

Note that, in the following description, a unit of the wager that can be bet by using the cashable credits or restricted credits described above is called "credit". For example, when one medal or coin is inserted as a wager into the slot machine 10 by the player, "1 credit" is bet as the wager. Moreover, for example, when two restricted credits are allocated to a wager by the player operating the slot machine 10, "2 credits" are bet as the wager.

Next, the slot machine 10 shown in FIG. 4 according to the example of the present invention determines whether or not predetermined conditions for executing a special game including a predetermined number (for example, 20) of unit games are satisfied (Step S2) as shown in FIG. 1A. This special game is also called a free game (feature game), for example. Whether or not the predetermined conditions are satisfied can be determined, for example, by whether or not a condition establishment lottery is won. Specifically, the condition establishment lottery is performed based on a random number generated by a random number generating circuit 112 shown in FIG. 5 every time the unit game is displayed on the display in Step S1.

If the predetermined conditions are not satisfied (NO in Step S2), the slot machine 10 terminates a series of processes once and displays the unit game on the display again in Step S1, as shown in FIG. 1A.

On the other hand, if the predetermined conditions are satisfied (YES in Step S2), the slot machine 10 determines a total amount of payout to be provided to the player in the special game on the basis of a payout lottery performed based on a random number generated by the random number generating circuit 112 shown in FIG. 5 (Step S3).

Subsequently, the slot machine 10 determines a symbol rearrangement pattern in the predetermined number of unit games to be executed in the special game so as to allow the total amount of payout determined in Step S3 to be generated in the special game (Step S4) as shown in FIG. 1A.

As determining the symbol rearrangement pattern, the slot machine 10 sets contents according to the total amount of payout determined in Step S3 as contents of a predetermined effect (rendition) to be displayed on the display in order to excite the player during the special game (Step S5).

Here, the contents of the effect to be displayed on the display is set, such that the larger the total amount of payout determined in Step S3 is, the contents announce in advance that the more payout is to be provided to the player in the free game.

For example, if the total amount of payout is a small value not more than 100 credits, an image 225 of an angel with wings folded shown in FIG. 8, the image announcing that a large payout is not to be provided in the free game, is determined as the contents of the effect to be displayed on the display.

On the other hand, if the total amount of payout is a large value exceeding 100 credits, an image 227 of an angel with wings spread shown in FIG. 9, the image announcing that a large payout is to be provided in the free game, can be determined as the contents of the effect to be displayed on the display.

Accordingly, the larger the total amount of payout determined in Step S3, the more the player is excited by the display of the effect on the display during the special game.

The effect determined in Step S5 can be displayed on a margin of a portion for displaying the unit game or the special game of the display 16 shown in FIG. 4. Moreover, the display can also be formed so as to include an upper display 33 shown in FIG. 4 to display the effect determined in Step S5 on the upper display 33 separately from the display of the unit game or the special game on the display 16.

Next, as shown in FIG. 1A, the slot machine 10 executes, as the special game, a predetermined number of unit games according to the symbol rearrangement pattern determined in Step S4 (Step S6) and displays the contents of the effect determined in Step S5 on the display (Step S7).

As a result, the slot machine 10 finishes providing the player with the total amount of payout determined in Step S3 in the form of credits or the like. Note that the payout in the special game can be provided every time the payout is generated in each of the unit games during the special game, or can be provided all at once at the end of the special game when all of the predetermined number of unit games are finished.

Subsequently, upon completion of executing the special game in Step S6 and displaying the effect on the display in Step S7, the slot machine 10 terminates the series of processes once and displays the unit game on the display again in Step S1.

Note that the contents of the effect to be displayed on the display can also be determined by a process different from the determination process executed by the slot machine 10 according to the example of the present invention in Step S5 shown in FIG. 1A.

For example, in a slot machine 10 according to another example of the present invention, as shown in Step S5*a* in FIG. 1B, contents of an effect corresponding to the total amount of payout determined in Step S3 in a table that associates the total amount of payout in the special game with contents of the effect to be displayed on the display are determined as the contents of the effect to be displayed on the display during the special game.

Therefore, in the slot machine 10 according to the another example of the present invention, the contents of the effect determined in Step S5*a* are set as the contents of the effect to be displayed on the display in Step S7.

Moreover, in the slot machines 10 according to the both examples described above, as shown in Steps S3 and S4 in FIGS. 1A and 1B, the total amount of payout to be provided to the player in the special game is determined first and then the symbol rearrangement pattern in the predetermined number of unit games corresponding to the total number is determined.

However, it is also possible to determine first the symbol rearrangement pattern in the predetermined number of unit games and then determine the total amount of payout to be provided to the player in the special game according to the determined symbol rearrangement pattern in the predetermined number of unit games.

Specifically, in a slot machine 10 according to still another example of the present invention, as shown in the flowchart in FIG. 1C, when the predetermined conditions for executing a special game are satisfied (YES in Step S2), a symbol rearrangement pattern in a predetermined number of unit games to be executed in the special game is determined, for example, by a payout lottery performed based on a random number generated by the random number generating circuit 112 shown in FIG. 5 (Step S3*a*).

Subsequently, the slot machine 10 finds the total amount of payout to be provided to the player in the special game on the basis of the symbol rearrangement pattern in the predetermined number of unit games determined in Step S3*a* (Step S4*a*). Thereafter, the slot machine 10 determines contents corresponding to the total amount of payout found in Step S4*a* as contents of a predetermined effect to be displayed on the display for exciting the player during the special game (Step S5*b*).

Therefore, in the slot machine 10 according to the still another example of the present invention, the predetermined number of unit games to be executed as the special game in Step S6 are executed according to the symbol rearrangement pattern determined in Step S3*a*. Moreover, the contents of the effect determined in Step S5*b* are set as the contents of the effect to be displayed on the display in Step S7.

As described above, in the slot machine 10 according to each of the examples of the present invention, when the special game is to be executed upon establishment of the predetermined conditions, the total amount of payout in the special game, the symbol rearrangement pattern in the unit games for generating the total amount of payout during the special game and the contents of the effect corresponding to the total amount of payout are determined before start of the special game.

Therefore, the contents corresponding to the total amount of payout to be actually provided to the player in the special game can be set as the contents of the effect to be displayed on the display during the special game. Thus, entertainment properties of the gaming machine can be improved by enabling the special game to make a proper and active appeal to the player by use of the effect.

Next, detailed description will be given of the slot machine according to the first embodiment of the present invention. As shown in FIG. 4, the slot machine 10 according to this embodiment includes the cabinet 11, a top box 12 provided on the cabinet 11 and a main door 13 provided on the front surface of the cabinet 11. On a front side of the main door 13, the display 16 is provided. The display 16 can include a liquid crystal panel capable of transparent display. As shown in FIG. 3, the display 16 has fifteen partitioned regions q11 to q53 arranged in a matrix pattern including first to fifth columns and first to third rows.

As shown in FIG. 4, on the display 16, the windows 16*a* to 16*e* are provided, which are always transparently displayed, so as to correspond to the first to fifth columns, respectively. Moreover, inside the cabinet 11, the rotating reel device 53 is disposed so as to be positioned behind the display 16.

As shown in FIG. 6A, the rotating reel device 53 has the five rotating reels 53*a* to 53*e* corresponding to the windows 16*a* to 16*e* in the display 16, respectively. Moreover, as shown in FIG. 6B, the rotating reel device 53 has drive motors 56*a* to

56*e* formed of stepping motors for rotatably driving the rotating reels 53*a* to 53*e* to be rotated, respectively. Furthermore, the rotating reel device 53 has sensors 54*a* to 54*e* (see FIG. 5) which read bar-codes and count the number of times of passing slits to detect the rotation, the stop of the rotation, and also the position of the rotational stop, of each of the rotatable reels 53*a* to 53*e*.

On the circumferential surface of each of the rotating reels 53*a* to 53*e*, as shown in FIG. 7, twenty-one symbols are laid out so as to be equally spaced apart. To be more specific, nine kinds of symbols, including "A (ace)", "K (king)", "Q (queen)", "J (jack)", "10", "umbrella", "lightning", "cloud" and "special (man's face)" are laid out in a predetermined pattern on each of the rotating reels 53*a* to 53*e*.

As shown in FIG. 4, the slot machine 10 of this embodiment allows the player to view three consecutive symbols among the twenty-one symbols laid out on the circumferential surface of each of the rotating reels 53*a* to 53*e* through each of the windows 16*a* to 16*e* on the display 16, the rotating reels corresponding to the windows, respectively. Specifically, each of the windows 16*a* to 16*e* on the display 16 includes each of groups of three, top, middle and bottom, partitioned regions q11 to q13, q21 to q23, q31 to q33, q41 to q43 and q51 to q53 in the row direction, the groups corresponding to the first to fifth columns, respectively.

Moreover, in the slot machine 10 of this embodiment, one slot game (unit game) is executed by rearranging the symbols, which are arranged in the partitioned regions q11 to q53 and are viewed by the player through the windows 16*a* to 16*e*, as shown in FIG. 2 by rotating and stopping each of the rotating reels 53*a* to 53*e*. This slot game can be generally executed by making a bet with game media. Meanwhile, as described later, the slot game can be executed without making a bet during a free game (special game) to be executed when predetermined conditions are satisfied.

During the free game, as shown in FIGS. 8 and 9, the image 225 of the angel with wings folded and the image 227 of the angel with wings spread are displayed as predetermined effects by using the margin around the windows 16*a* to 16*e* on the display 16.

Note that, in this embodiment, medals are taken as an example of the game media to be used for executing the slot game (except during the free game). However, the game media for the slot game are not limited to the medals but may include, for example, tokens, electronic money and valuable electronic information (credits) equivalent thereto.

Below the display 16, provided are: an input button 23 used by the player to input instructions related to a game process; a coin acceptor 21 for accepting coins; and a bill validator 22 for validating whether or not bills are legitimate and accepting the legitimate bills. Note that the bill validator 22 may be configured to be able to read a bar-coded ticket 39.

Moreover, in the vicinity of the medal insertion slot 21 and the bill validator 22, various operation switches are provided. As the operation switches, a payout switch 23, a MAXBET switch 24, a BET switch 25, a spin repeat bet switch 26 and a start switch 27 are provided.

The BET switch 25 is a switch for determining the number of credits to be bet on the slot game to be executed on the display 16. As described later, every time the BET switch 25 is pressed, a credit equivalent to one medal is bet.

The spin repeat bet switch 26 is a switch for executing the slot game by betting the same amount of credits as that bet in the previous game with BET switch 25 described above.

The start switch 27 is a switch for starting the slot game after a desired number of credits are bet. When the start switch 27 is pressed after medals are inserted into the medal insertion slot 21 or credits are bet by use of the BET switch 25, the slot game is started on the display 16.

The payout switch 23 is a switch for paying out the inserted medals. The medals to be paid out are discharged from a medal payout opening 19 provided in a lower front portion of the main door 13. The medals paid out are accumulated in a medal tray 18.

The MAXBET switch 24 is a switch for betting, in one operation, the maximum number of credits (for example, 30 medals) that can be bet on one slot game.

On a lower front surface of the main door 13, a foot display 34 is provided, which displays a predetermined screen on the basis of image display control data included in game software that is being executed.

On a front surface of the top box 12, an upper display 33 is provided. The upper display 33 includes a liquid crystal panel to display a payout table and the like.

Moreover, a speaker 29 is provided in the top box 12. Below the upper display 33, a ticket printer 35, a card reader 36, a data display 37 and a keypad 38 are provided. The ticket printer 35 prints out a bar-code on a ticket, the bar-code having coded data such as the number of credits, time and date and an identification number of the slot machine 10, and outputs the ticket as the bar-coded ticket 39.

The player can use the bar-coded ticket 39 to make a bet on a slot game with another slot machine by allowing the slot machine to read the bar-coded ticket 39 or can change the bar-coded ticket 39 for bills and the like at a predetermined location in a gaming facility (for example, a cashier in a casino).

The card reader 36 allows a smart card to be inserted thereinto, reads data from the inserted smart card and writes data into the smart card. The smart card is a card carried by the player and stores data for identifying the player and data on a history of games played by the player.

The smart card may store data corresponding to coins, bills or credits. Moreover, instead of the smart card, a magnetic stripe card may be employed. The data display 37 is formed of a fluorescent display or the like and displays, for example, the data read by the card reader 36 and data inputted by the player using the keypad 38.

Moreover, instead of the smart card, an RFID card capable of reading and writing data contactlessly may be used. The keypad 38 is for inputting instructions or data for ticketing and the like.

FIG. 5 is a block diagram showing a control circuit in the slot machine according to this embodiment. A machine controller 40 shown in FIG. 5 is a microcomputer, including an interface circuit group 102, an I/O bus 104, a CPU 106, a ROM 108, a RAM 110, a communication interface circuit 111, a random number generating circuit 112, an external storage device 113, a speaker driving circuit 122, a hopper driving circuit 124, a display driving circuit 128, display controllers 140 and 141, a motor driving circuit 51 for driving the respective drive motors 56*a* to 56*e* in the rotating reel device 53, and a reel position detecting circuit 52 for detecting the rotation, the stop of the rotation, and also the position of the rotational stop, of each of the rotatable reels 53*a* to 53*e* on the basis of outputs from the respective sensors 54*a* to 54*e* in the rotating reel device 53.

Each of the sensors 54*a* to 54*e* is disposed so as to face a margin 55 provided in parallel with a layout area of the symbols on the circumferential surface of each of the rotating reels 53*a* to 53*e* corresponding thereto. Moreover, each of the sensors 54*a* to 54*e* can detect the rotation, the stop of the rotation, and also the position of the rotational stop, of each of the rotatable reels 53*a* to 53*e* by detecting identifiers such as bar-codes laid out on the margin 55 so as to correspond to the respective symbols. Note that, for the detection of the identifiers by each of the sensors 54*a* to 54*e*, various known methods can be used, such as an optical method and a magnetic method.

The interface circuit group 102 is connected to the I/O bus 104. The I/O bus 104 inputs and outputs a data signal or an address signal to and from the CPU 106.

The start switch 27 is connected to the interface circuit group 102. A start signal outputted from the start switch 27 is converted into a predetermined signal by the interface circuit group 102 and then transmitted to the CPU 106 through the I/O bus 104.

The BET switch 25, the MAXBET switch 24, the spin repeat bet switch 26 and the payout switch 23 are further connected to the interface circuit group 102. Each of switching signals outputted from the switches 25, 24, 26 and 23 is supplied to the interface circuit group 102, converted into a predetermined signal by the interface circuit group 102 and then transmitted to the CPU 106 through the I/O bus 104.

In addition, a medal sensor 43 is connected to the interface circuit group 102. The medal sensor 43 is a sensor for detecting medals inserted into the medal insertion slot 21 and is provided in a medal insertion part of the medal insertion slot 21. A detection signal outputted by the medal sensor 43 is supplied to the interface circuit group 102, converted into a predetermined signal by the interface circuit group 102 and then transmitted to the CPU 106 through the I/O bus 104.

The ROM 108 for storing system programs and the RAM 110 for storing various data are connected to the I/O bus 104. In the RAM 110, areas and the like for managing flags and storing various information are provided.

The ROM 108 stores a payout table. The payout table shows a correspondence relationship between conditions for generating a payout and the number of credits to be paid out when the conditions are satisfied. The conditions for generating a payout are determined by contents of the symbols rearranged in the partitioned regions q11 to q53 on the display 16. The contents of rearrangement of the symbols to generate a payout can be determined by the number of scatter symbols rearranged in a slot game or a pattern of a winning combination formed on a payline set in the partitioned regions q11 to q53. In the slot game of this embodiment, the CPU 106 determines whether or not to generate a payout (whether or not to pay out credits) and the credit payout amount (the number of credits to be paid out) on the basis of the payout table and the symbols stopped in each of the partitioned regions q11 to q53.

Upon receipt of a game start operation from the start switch 27, the CPU 106 executes a slot game by reading a game execution program from the ROM 108. The game execution program is a program for executing the slot game by driving the respective drive motors 56*a* to 56*e* in the rotating reel device 53 through the motor driving circuit 51.

To be more specific, the game execution program is configured to execute the following slot game. Specifically, symbol varying and displaying is performed simultaneously in the partitioned regions q11 to q53 on the display 16 and then the symbols are stopped. When the symbols are rearranged so as to form a pattern for providing a payout, credits are paid out according to the payout amount based on the payout table stored in the ROM 108.

The random number generating circuit 112, the communication interface circuit 111, the external storage device 113, the display controllers 140 and 141, the hopper driving circuit 124, the speaker driving circuit 122, the display driving circuit 128, the motor driving circuit 51 and the reel position detecting circuit 52 are further connected to the I/O bus 104.

The communication interface circuit 111 is connected to a hall server and the like and transmits to the hall server data on a history of plays executed in the slot machine 10. Moreover, the communication interface circuit 111 receives various data transmitted from the hall server.

The random number generating circuit 112 generates a random number for determining whether or not to generate a winning combination or a jackpot in a slot game executed on the display 16.

The external storage device 113 stores a correspondence table (a table) concerning a predetermined number of slot games (for example, 20 games) to be executed as a free game when predetermined conditions are satisfied. As shown in FIG. 13, in the correspondence table, the total amount of payout in the free game and the contents of the effect to be displayed in the margin around the windows 16*a* to 16*e* on the display 16 are associated with each other.

In this embodiment, in the correspondence table, a case where the total amount of payout in the free game is not more than 100 credits is associated with the image 225 of the angel with wings folded shown in FIG. 8 as the contents of the effect to be displayed on the display 16. Moreover, a case where the total amount of payout in the free game exceeds 100 credits is associated with the image 227 of the angel with wings spread shown in FIG. 9 as the contents of the effect to be displayed on the display 16.

The display driving circuit 128 performs control of displaying the amount of payout in a payout amount defined region 48 set in the lower left area of the display 16.

The speaker driving circuit 122 outputs sound data to the speaker 29. Specifically, the CPU 106 reads sound data stored in the ROM 108 and transmits the sound data to the speaker driving circuit 122 through the I/O bus 104. Thus, predetermined sound effects are emitted from the speaker 29.

The hopper driving circuit 124 outputs a payout signal to the hopper 44 when a payout is generated. Specifically, when a payout signal is inputted by the payout switch 23, the CPU 106 outputs a driving signal to the hopper driving circuit 124 through the I/O bus 104. Thus, the hopper 44 pays out medals equivalent to the number of credits remaining at the time, which is stored in a predetermined memory region of the RAM 110.

The display controller 140 performs display control for always transparently displaying the windows 16*a* to 16*e* on the display 16. Specifically, the CPU 106 generates an image display command signal for always transparently displaying the windows 16*a* to 16*e* and outputs the image display command signal to the display controller 140 through the I/O bus 104. Upon receipt of the image display command signal outputted by the CPU 106, the display controller 140 generates a driving signal for driving the display 16 on the basis of the image display command and outputs the generated driving signal to the display 16. Thus, the windows 16*a* to 16*e* are always transparently displayed on the display 16.

Moreover, the display controller 140 performs display control for displaying the image 225 of the angel with wings folded shown in FIG. 8 or the image 227 of the angel with wings spread shown in FIG. 9 in the margin around the windows 16*a* to 16*e* on the display 16 during the free game. Specifically, the CPU 106 generates an image display command signal for displaying the image 225 of the angel with wings folded shown in FIG. 8 or the image 227 of the angel with wings spread shown in FIG. 9 in the margin around the windows 16*a* to 16*e* during the free game and outputs the image display command signal to the display controller 140 through the I/O bus 104. Upon receipt of the image display command signal outputted by the CPU 106, the display controller 140 generates a driving signal for driving the margin around the windows 16*a* to 16*e* on the display 16 on the basis of the image display command and outputs the generated driving signal to the display 16. Thus, the image 225 of the angel with wings folded shown in FIG. 8 or the image 227 of the angel with wings spread shown in FIG. 9 is displayed in the margin around the windows 16*a* to 16*e* on the display 16 during the free game.

The display controller 141 performs control of displaying a predetermined screen on the upper display. Specifically, the CPU 106 generates an image display command signal corresponding to the predetermined screen and outputs the image display command signal to the display controller 141 through the I/O bus 104. Upon receipt of the image display command signal outputted by the CPU 106, the display controller 141 generates a driving signal for driving the upper display 33 on the basis of the image display command and outputs the generated driving signal to the upper display 33. Thus, the predetermined screen is displayed on the upper display 33. The predetermined screen can be displayed by use of a still image or a moving image.

Figure 10:
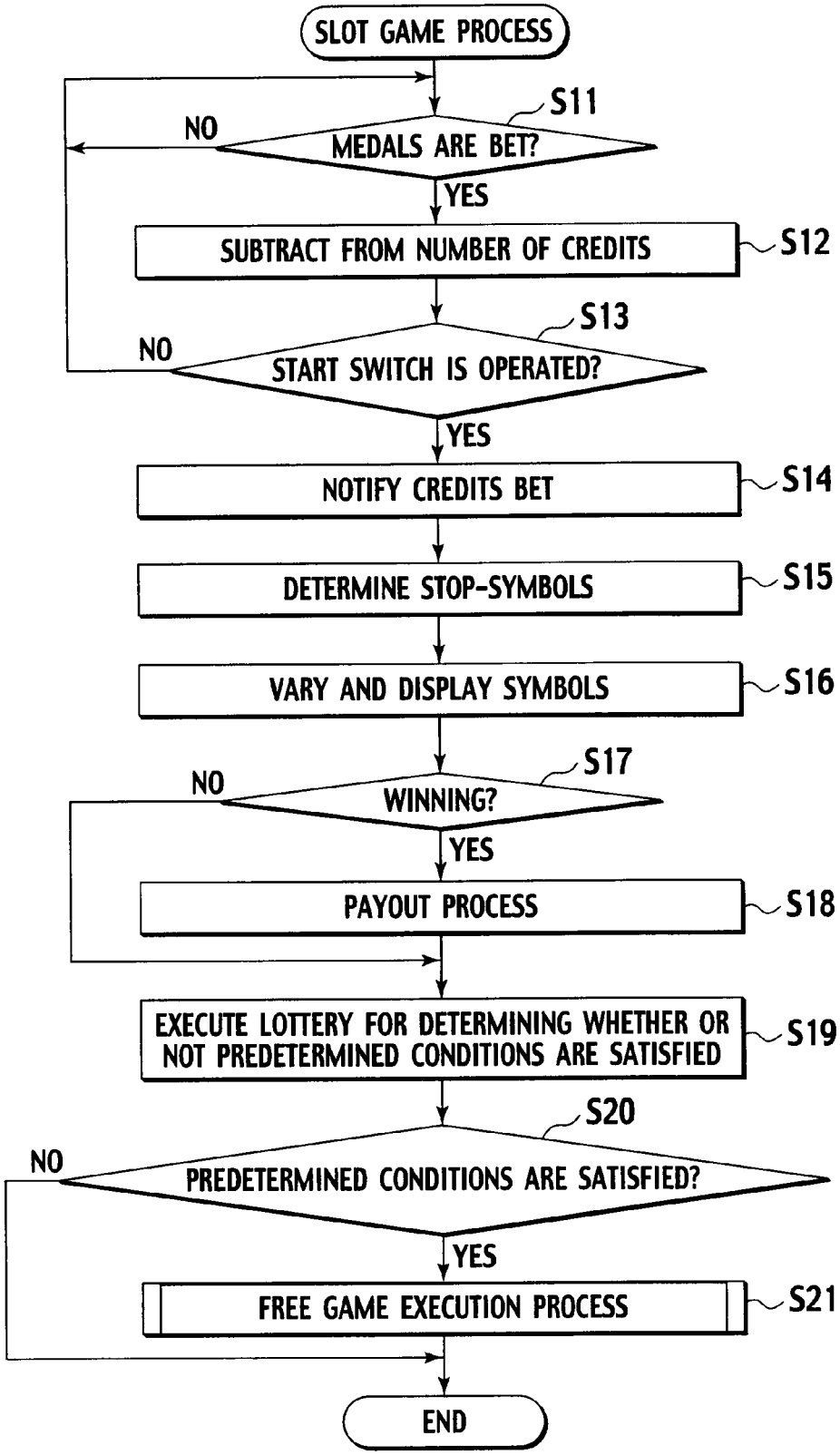
FIG. 10 is a flowchart showing processing procedures executed by the slot machine according to the first embodiment of the present invention.
Figure 11:
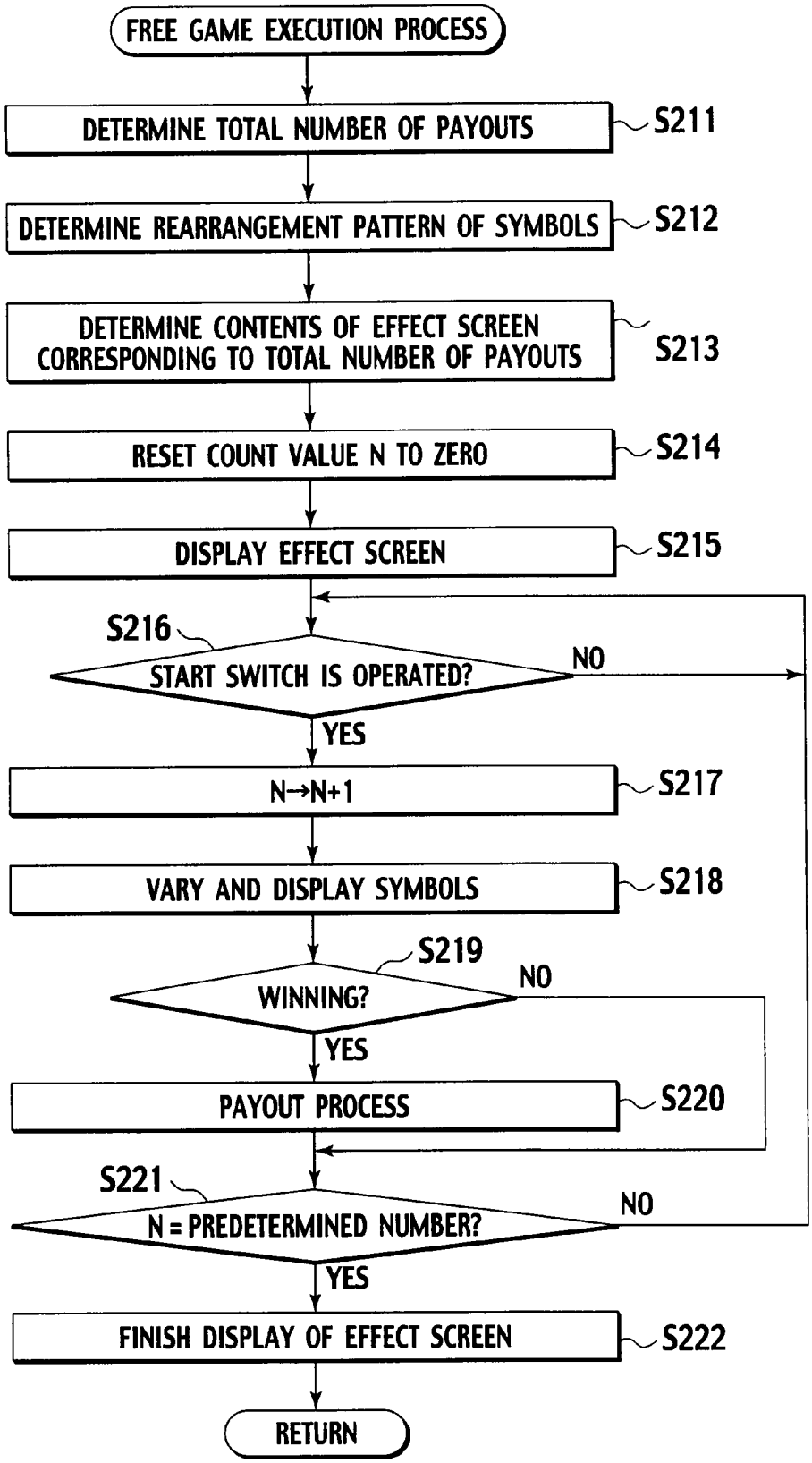
FIG. 11 is a flowchart showing processing procedures executed by the slot machine according to the first embodiment of the present invention.
Figure 12:
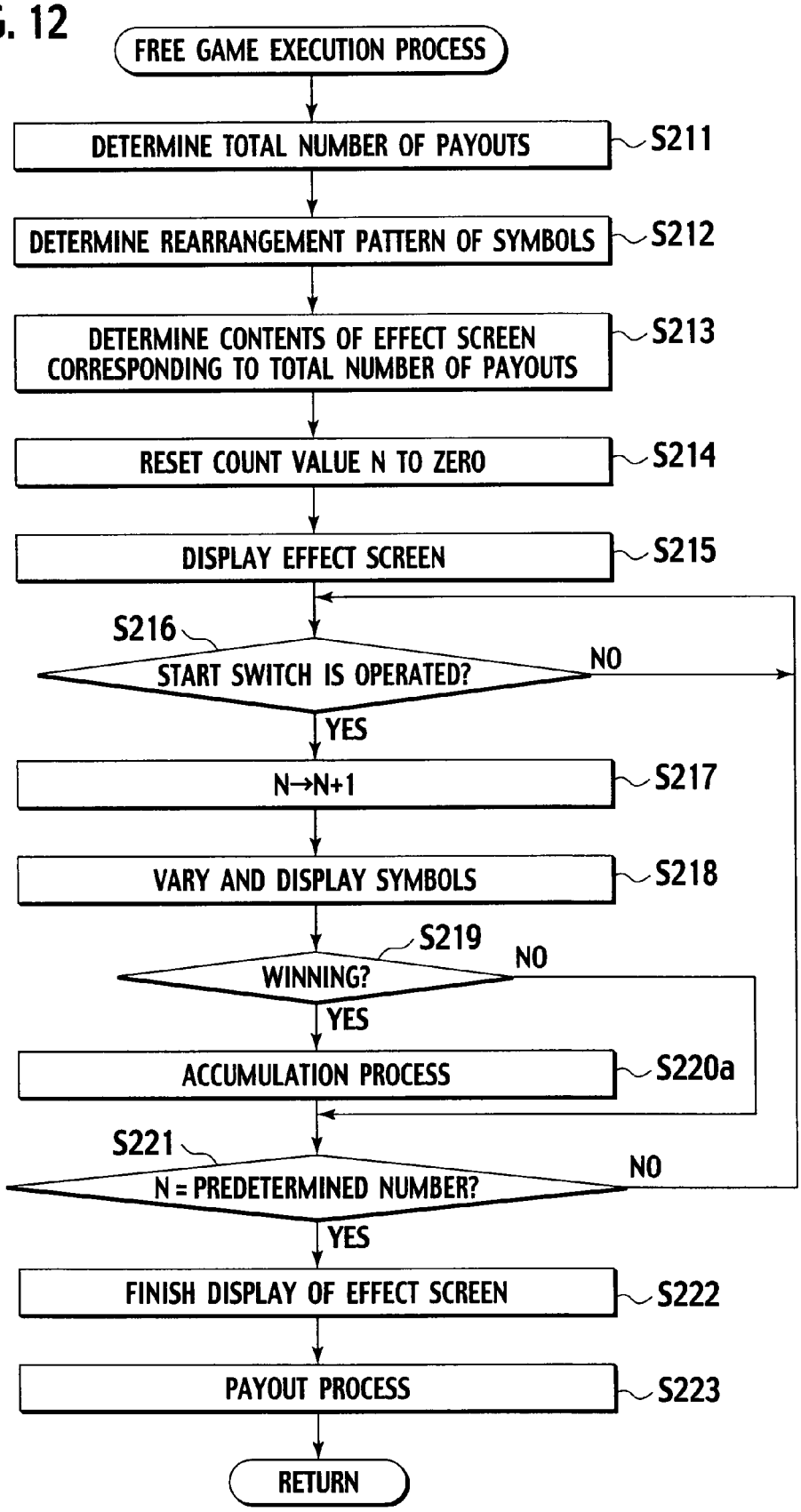
FIG. 12 is a flowchart showing processing procedures executed by the slot machine according to the first embodiment of the present invention.

Next, with reference to flowcharts shown in FIGS. 10 to 12, operations of the slot machine 10 according to this embodiment will be described. FIGS. 10 to 12 are the flowcharts showing procedures of slot game processing and free game execution processing, which are executed by the CPU 106 shown in FIG. 5 according to the game execution program stored in the ROM 108.

In the slot game processing shown in FIG. 10, first, the CPU 106 determines whether or not credits are bet in Step S11. In this processing, the CPU 106 determines whether or not a signal outputted from the BET switch 25 when the BET switch 25 is pressed or a signal outputted from the MAXBET switch 24 when the MAXBET switch 24 is pressed is received. When the CPU 106 determines that no credits are bet, the processing returns to Step S11.

Meanwhile, when, in Step S11, the CPU 106 determines that the credits are bet, the CPU 106 moves to Step S12 and reduces the number of credits stored in the RAM 110 according to the number of the credits bet.

Next, in Step S13, the CPU 106 determines whether or not the start switch 27 is pressed. In this processing, the CPU 106 determines whether or not a signal outputted from the start switch 27 when the start switch 27 is pressed is received.

When the CPU 106 determines that the start switch 27 is not pressed, the CPU 106 returns the processing to Step S11. Note that, when the start switch 27 is not pressed (for example, when an instruction to finish the game is inputted instead of pressing the start switch 27), the CPU 106 cancels a result of reduction in the number of credits in Step S12.

Meanwhile, when, in Step S13, the CPU 106 determines that the start switch 27 is pressed, the CPU 106 moves to Step S14 from Step S13 and notifies the number of the credits bet to a payout controller 3. At the same time, the CPU 106 determines stop-symbols in Step S15. In this stop-symbol determination processing, the CPU 106 determines the symbols to be stopped and displayed (rearranged) in the respective display regions q11 to q53 by executing a stop-symbol determination program that is one of the game execution programs stored in the ROM 108.

By the stop-symbol determination processing, in the slot machine 10, the symbols to be rearranged in the partitioned regions q11 to q53 on the first to fifth columns shown in FIG. 3 are determined among the nine kinds of symbols including "A (ace)", "K (king)", "Q (queen)", "J (jack)", "10", "umbrella", "lightning", "cloud" and "special (man's face)" shown in FIG. 7.

Figure 14:
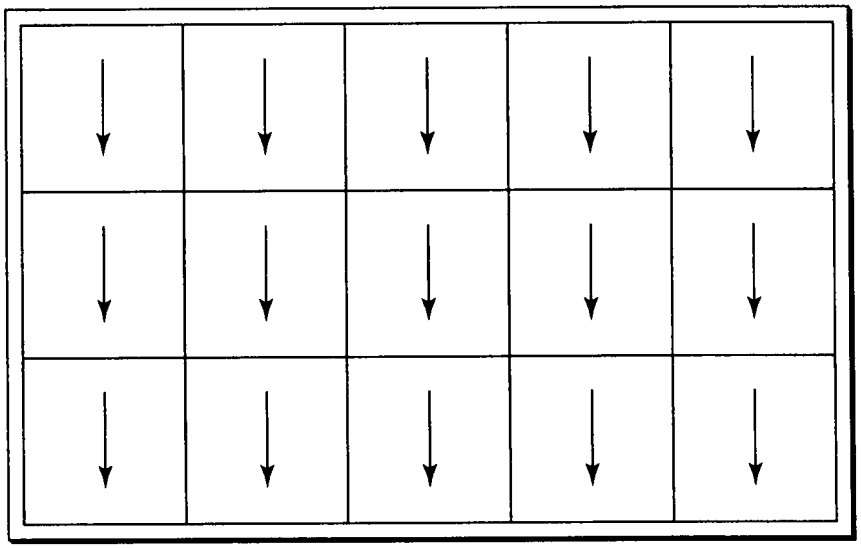
FIG. 14 is an explanatory view showing a display example of a slot game executed on the display in the slot machine according to the first embodiment of the present invention.
Figure 15:
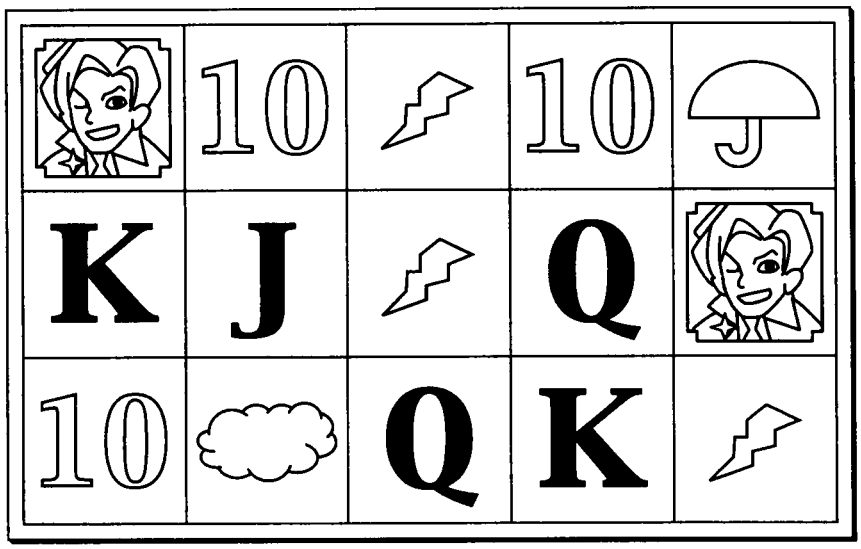
FIG. 15 is an explanatory view showing a display example of the slot game executed on the display in the slot machine according to the first embodiment of the present invention.

Next, the CPU 106 performs symbol varying and displaying processing in Step S16. In this processing, symbol varying and displaying is started in the display regions q11 to q53 as shown in FIG. 14 and then the symbols are stopped in the display regions q11 to q53 as shown in FIG. 15. By this processing of starting the varying and displaying and of stopping the symbols, the symbols are rearranged in the display regions q11 to q53. The symbol varying and displaying processing in Step S16 is executed by rotating and stopping the rotating reels 53*a* to 53*e* in the rotating reel device 53 by driving the respective drive motors 56*a* to 56*e* through the motor driving circuit 51.

When the symbol varying and displaying processing is finished, the CPU 106 moves to Step S17 and determines whether or not there is a winning combination on the basis of the symbols rearranged in the partitioned regions q11 to q53. Specifically, the CPU 106 determines whether or not conditions for providing an award are satisfied.

In Step S17, the CPU 106 refers to the payout table stored in the ROM 108 and determines whether or not a pattern of the symbols rearranged in Step S16 described above coincides with any one of symbol rearrangement patterns to provide a payout, which are set in the payout table.

If the pattern of the symbols rearranged coincides with any one of the symbol rearrangement patterns set in the payout table, a winning combination is considered to be established. Thus, the payout amount set so as to correspond to the symbol rearrangement pattern is determined as the number of credits to be paid out. Thereafter, the processing moves to the next Step S18 from Step S17.

Meanwhile, if the pattern of the symbols rearranged in Step S16 described above does not coincide with any one of the symbol rearrangement patterns to provide a payout, which are set in the payout table, no winning combination is considered to be established. Thus, the CPU 106 moves the processing to Step S19 to be described later.

In Step S18, the CPU 106 executes processing of paying out credits corresponding to a result of the winning combination in Step S16 described above. In this payout processing, the CPU 106 adds the number of credits to be paid out, which is obtained in Step S17 described above, to the number of credits stored in the RAM 110.

In Step S19, the CPU 106 uses a random number generated by the random number generating circuit 112 to perform a lottery for determining whether or not predetermined conditions for starting the free game are satisfied. Thereafter, in Step S20, the CPU 106 determines whether or not an outcome of the lottery satisfies the predetermined conditions.

If the outcome of the lottery does not satisfy the predetermined conditions (the conditions are dissatisfied) (NO in Step S20), the CPU 106 returns to Step S11 described above to execute next slot game processing. If the outcome of the lottery satisfies the predetermined conditions (YES in Step S20), the CPU 106 performs free game execution processing in Step S21 and then returns to Step S11 described above to execute next slot game processing.

In the free game execution processing in Step S21, as shown in FIG. 11, the CPU 106 uses a random number generated by the random number generating circuit 112 to determine, in Step S211, the total amount of payout to be provided in a predetermined number of slot games (20 games in this embodiment) to be executed during the free game. Next, the CPU 106 determines a symbol rearrangement pattern in the predetermined number of slot games for providing in the free game the total amount of payout determined in Step S211 (Step S212).

The determination of the symbol rearrangement pattern in Step S212 can be executed, for example, by referring to a pattern table in which the total amount of payout to be provided in the free game and the symbol rearrangement pattern in the predetermined number of slot games are associated with each other. Such a pattern table can be provided in the program stored in the ROM 108 or can also be stored in the external storage device 113, for example.

Subsequently, the CPU 106 determines contents of an effect associated with the total amount of payout determined in Step S211 in the correspondence table stored in the external storage device 113 as contents of an effect to be displayed during the free game in the margin around the windows 16*a* to 16*e* on the display 16 (Step S213).

Thereafter, a count value N in a free game counter provided in the RAM 110 and a count value n in a specified game number counter are reset to zero by the CPU 106 (Step S214). Furthermore, the contents of the effect determined in Step S213 are displayed in the margin around the windows 16*a* to 16*e* on the display 16 (Step S215).

Next, the CPU 106 determines whether or not the start switch 27 is pressed (Step S216). In this processing, the CPU 106 determines whether or not a signal outputted from the start switch 27 when the start switch 27 is pressed is received.

When the CPU 106 determines that the start switch 27 is not pressed (NO in Step S216), the CPU 106 repeats the process in Step S216. On the other hand, when the CPU 106 determines that the start switch 27 is pressed (YES in Step S216), the CPU 106 increments the count value N in the free game counter provided in the RAM 110 by "1" in Step S217. Subsequently, in Step S218, the CPU 106 performs symbol varying and displaying processing. In this symbol varying and displaying processing, the symbols are rearranged in the pattern determined in Step S212.

Next, in Step S219, the CPU 106 refers to the payout table stored in the ROM 108 and determines whether or not a pattern of the symbols rearranged in Step S218 described above coincides with any one of symbol rearrangement patterns to provide a payout, which are set in the payout table.

If the pattern of the symbols rearranged coincides with any one of the symbol rearrangement patterns set in the payout table, a winning combination is considered to be established. Thus, the CPU 106 executes processing of paying out the number of credits set so as to correspond to the symbol rearrangement pattern (Step S220). In this payout processing, the CPU 106 adds the number of credits to be paid out, which corresponds to the winning combination formed by the symbols rearranged in Step S218 described above, to the number of credits stored in the RAM 110.

Next, in Step S221, the CPU 106 determines whether or not the count value N in the free game counter provided in the RAM 110 reaches the predetermined number (20 in this embodiment) that is the number of slot games to be executed during the free game.

When the count value N in the free game counter does not reach the predetermined number (NO in Step S221), the CPU 106 moves to Step S216. On the other hand, when the count value N reaches the predetermined number (YES in Step S221), the CPU 106 finishes the display of the effect in the margin around the windows 16*a* to 16*e* on the display 16 in Step S222. Thereafter, the CPU 106 terminates the free game execution processing.

Note that the free game execution processing can also be carried out in the following manner. Specifically, as shown in FIG. 12, instead of the payout processing for paying out the number of credits corresponding to the symbols rearranged in Step S218 to provide a payout, the payout processing being performed in Step S220 shown in FIG. 11, accumulation processing for accumulating the credits to be paid out is executed (Step S220*a*). Next, after the display of the effect is finished in Step S222, payout processing for paying out the accumulated credits all at once is performed (Step S223). Thereafter, the free game execution processing is terminated.

As is clear from the above description, the CPU 106 in this embodiment forms a controller.

In the slot machine 10 according to this embodiment having the above configuration, when the free game is executed upon satisfaction of the predetermined conditions, the total amount of payout in the free game, which is provided by the slot machine 10, is determined before start of the free game.

If the determined total amount of payout in the free game is a small value not more than 100 credits, the image 225 of the angel with wings folded shown in FIG. 8, the image announcing that a large payout is not to be provided in the free game, is displayed in the margin around the windows 16*a* to 16*e* on the display 16.

On the other hand, if the determined total amount of payout is a large value exceeding 100 credits, the image 227 of the angel with wings spread shown in FIG. 9, the image announcing that a large payout is to be provided in the free game, is displayed in the margin around the windows 16*a* to 16*e* on the display 16.

Therefore, the contents corresponding to the total amount of payout to be actually provided to the player in the free game can be set as the contents of the effect to be displayed in the margin around the windows 16*a* to 16*e* on the display 16 during the free game.

Thus, when a large amount of payout exceeding 100 credits are to be provided to the player in the free game, the image 227 of the angel with wings spread shown in FIG. 9 is set as the effect to be displayed on the display 16 during the free game. Thus, by use of the effect to be displayed, it is possible to make an active and proper appeal to the player that he/she has a chance to get a large payout.

Moreover, if the total amount of payout to be provided to the player in the free game is a relatively small value not more than 100 credits, the image 225 of the angel with wings folded shown in FIG. 8 is set as the effect to be displayed on the display 16 during the free game. Thus, the appeal of the free game to the player, which is performed by use of the effect to be displayed, can be prevented from being excessive compared to a small amount of payout to be actually provided to the player in the free game.

Meanwhile, the correspondence table used to determine, in Step S213, the contents of the effect corresponding to the total amount of payout determined in Step S211 in FIG. 11 or FIG. 12 can also be provided, for example, in the program stored in the ROM 108 instead of being stored in the external storage device 113.

Note that, in this embodiment, the total amount of payout to be provided to the player in the free game is determined first and then the symbol rearrangement pattern in the predetermined number of slot games corresponding to the total number is determined.

However, it is also possible to determine first the symbol rearrangement pattern in the predetermined number of slot games and then determine the total amount of payout to be provided to the player in the free game according to the determined symbol rearrangement pattern in the predetermined number of slot games.

Figure 16:
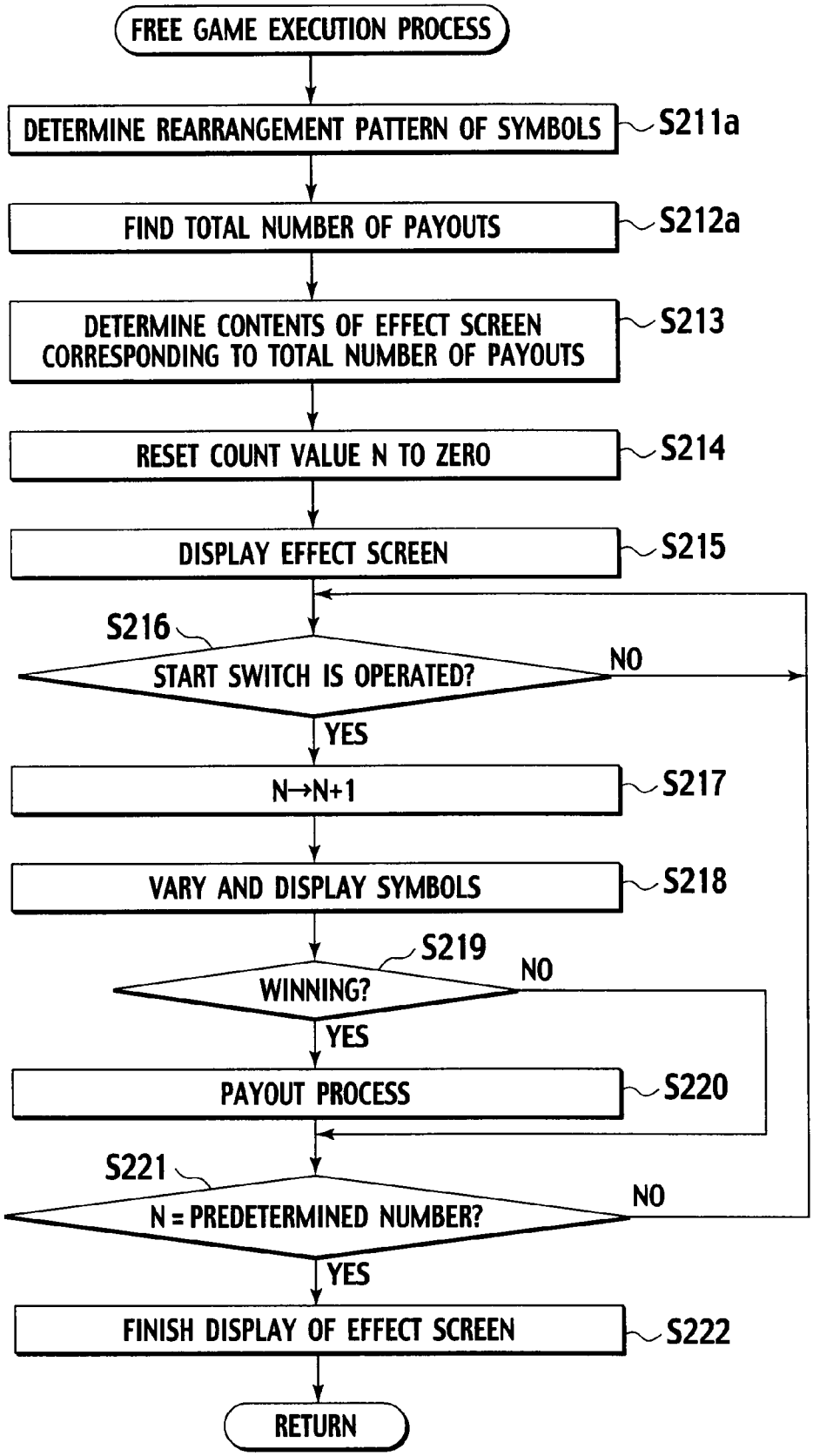
FIG. 16 is a flowchart showing processing procedures executed by a slot machine according to the second embodiment of the present invention.
Figure 17:
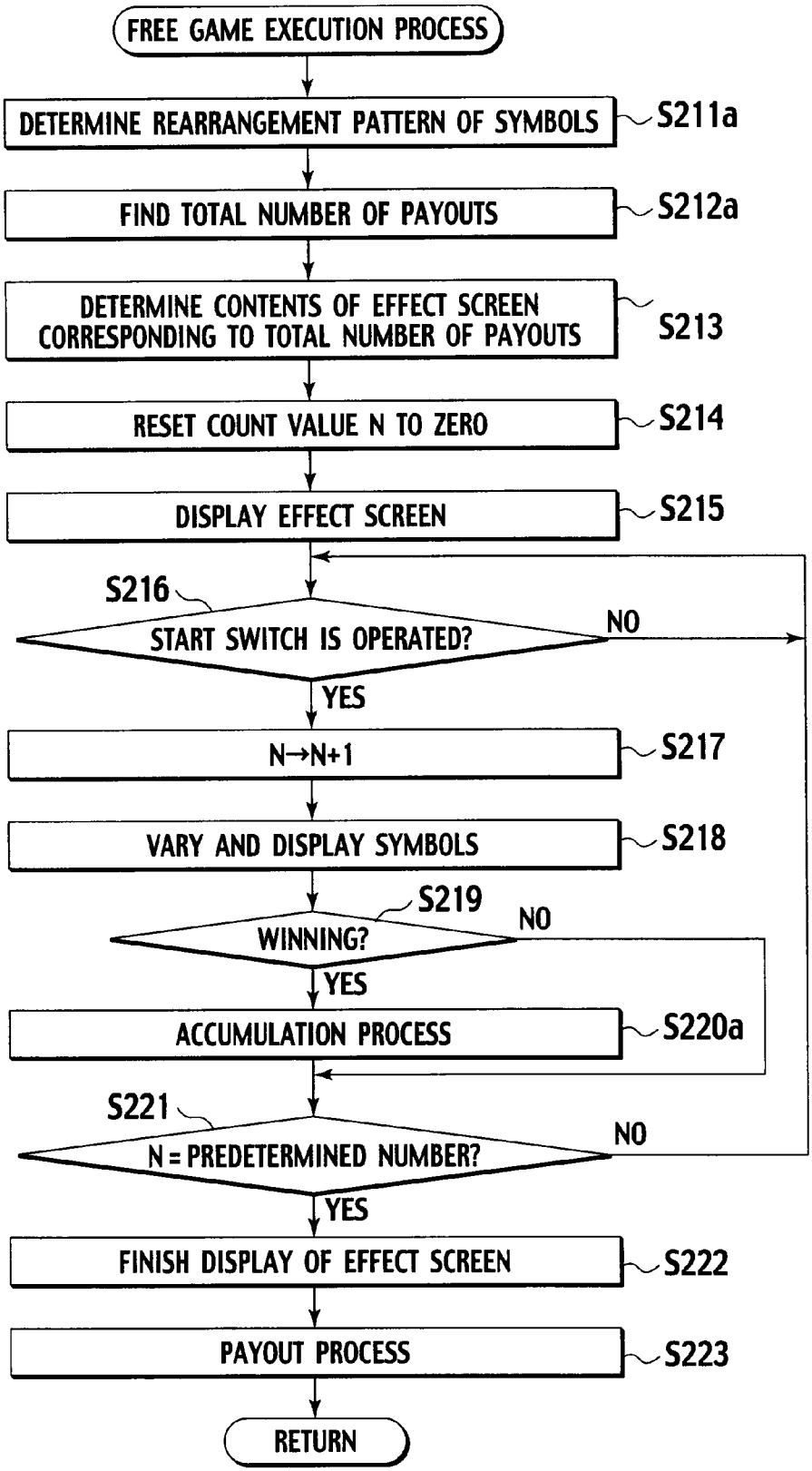
FIG. 17 is a flowchart showing processing procedures executed by the slot machine according to the second embodiment of the present invention.

A slot machine according to a second embodiment of the present invention having a configuration as described above and a playing method thereof will be described below with reference to FIGS. 16 and 17. FIGS. 16 and 17 are flowcharts showing procedures of processing executed by the slot machine according to the second embodiment of the present invention.

In the processing executed by the slot machine according to the second embodiment of the present invention, some of contents of free game execution processing performed by a CPU 106 are different from the contents of the free game execution processing in the first embodiment shown in FIG. 11 or FIG. 12.

Thus, in the slot machine according to the second embodiment, as shown in FIGS. 16 and 17, first, in the free game execution processing in Step S21 shown in FIG. 10, the CPU 106 uses a random number generated by the random number generating circuit 112 to determine a symbol rearrangement pattern in a predetermined number of slot games (20 games in this embodiment) to be executed during a free game (Step S211*a*). Next, the CPU 106 finds the total amount of payout to be provided in the free game on the basis of the symbol rearrangement pattern in the predetermined number of slot games determined in Step S211*a* (Step S212*a*). Thereafter, the processes in Steps S213 to S222 shown in FIG. 11 are executed.

The slot machine and playing method thereof according to the second embodiment as described above can also achieve the same effects as those achieved by the slot machine 10 and playing method thereof according to the first embodiment.

Moreover, in the slot machine and playing method thereof according to the second embodiment, only by changing determination of the symbol rearrangement pattern in the slot game during the free game, the pattern being normally determined for each slot game, to collective determination for a predetermined number of slot games before start of the free game among the procedures of the processing of the predetermined number of slot games to be executed during the free game, the total amount of payout to be provided to the player in the free game can be determined before the start of the free game.

Thus, display of contents of an effect corresponding to the total amount of payout to be provided to the player in the free game can be achieved while minimizing changes in the procedures of the processing of the predetermined number of slot games to be executed during the free game.

In each of the first and second embodiments described above, the display 16 includes the liquid crystal panel capable of transparent display. Moreover, rearrangement of the symbols in the partitioned regions q11 to q53 is performed by the rotating reel device disposed behind the display.

However, rearrangement of the symbols in the partitioned regions q11 to q53 on the display 16 can also be performed by display on the liquid crystal panel included in the display 16.

Figure 18:
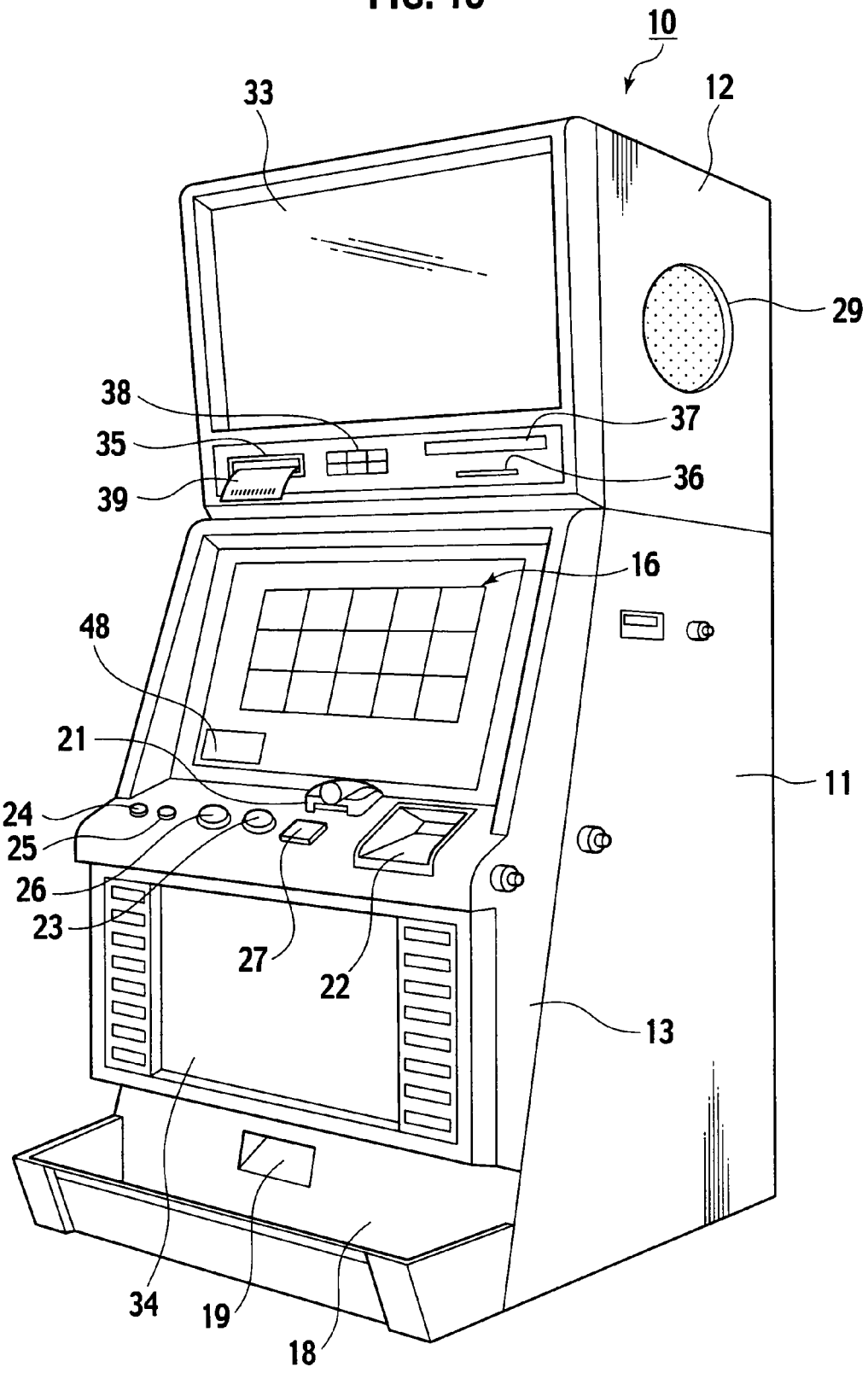
FIG. 18 is a perspective view of a slot machine according to the third embodiment of the present invention.
Figure 19:
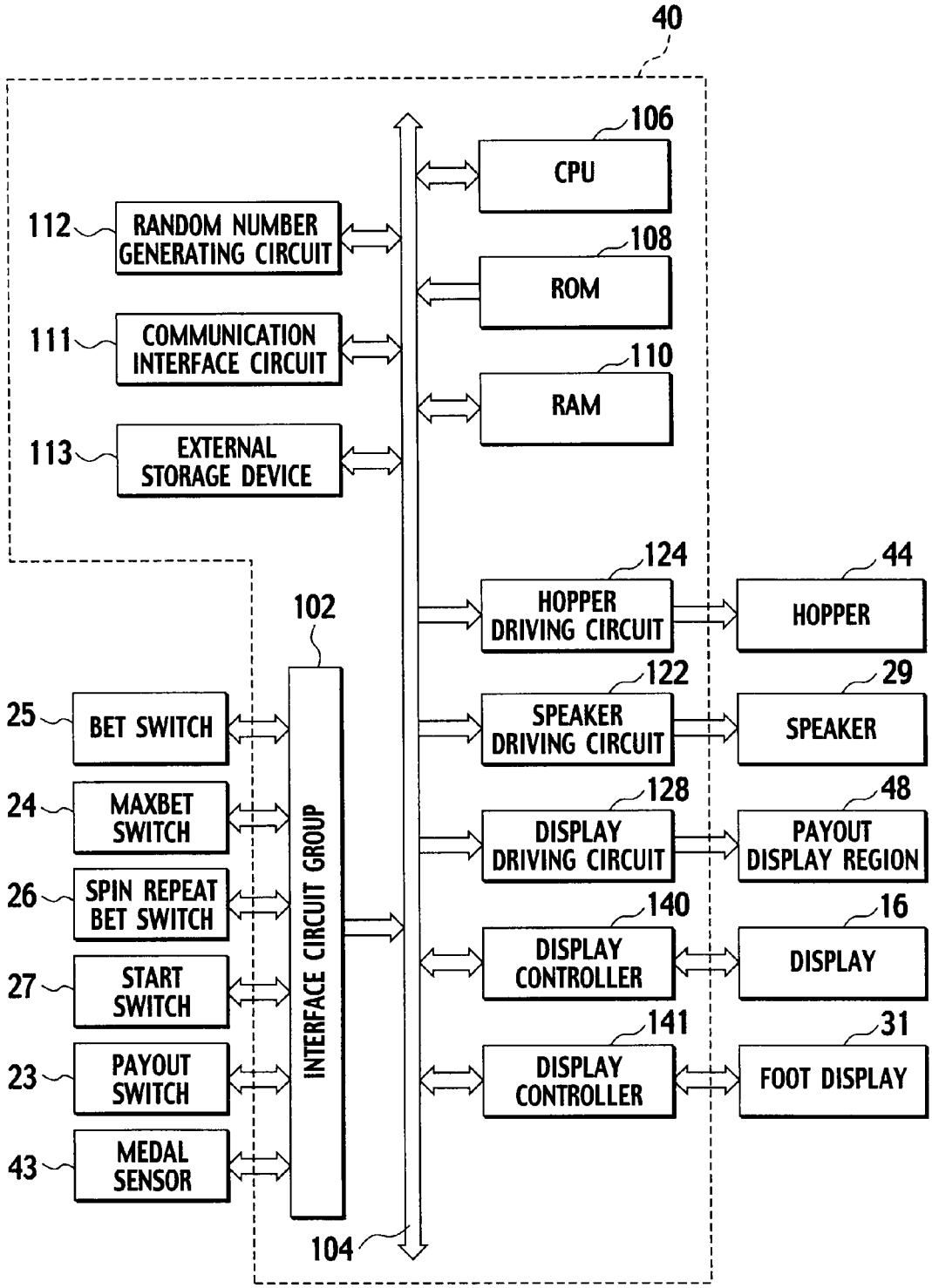
FIG. 19 is a block diagram showing a control circuit in the slot machine according to the third embodiment of the present invention.

Hereinafter, description will be given of a slot machine according to a third embodiment of the present invention, in which symbol rearrangement is performed by display on the liquid crystal panel included in the display 16, and a playing method thereof. FIG. 18 is a perspective view of the slot machine according to the third embodiment of the present invention. FIG. 19 is a block diagram showing a control circuit in the slot machine according to the third embodiment of the present invention.

As shown in FIG. 18, in the slot machine 10 according to the third embodiment of the present invention, the windows 16*a* to 16*e* on the display 16 and the rotating reel device 53 including the rotating reels 53*a* to 53*e* disposed therebehind (see FIGS. 6A and 6B) in the slot machine 10 according to the first embodiment are omitted.

Moreover, in the slot machine 10 of this embodiment, the motor driving circuit 51 and the reel position detecting circuit 52 in the machine controller 40 in the slot machine 10 of the first embodiment are omitted as shown in FIG. 19. Note that, along with omission of the rotating reel device 53, also omitted are the drive motors 56*a* to 56*e* in the rotating reel device 53, which are driven by the motor driving circuit 51, and the sensors 54*a* to 54*e* for detecting, through the reel position detecting circuit 52, the rotation, the stop of the rotation, and also the position of the rotational stop, of each of the rotatable reels 53*a* to 53*e*.

Note that, in the slot machine 10 of this embodiment, a display controller 140 performs display control for executing an effect corresponding to a slot game and an outcome of the slot game on the display 16. Specifically, the CPU 106 generates an image display command signal corresponding to a state of the slot game and the outcome of the slot game and outputs the image display command signal to the display controller 140 through the I/O bus 104. Upon receipt of the image display command signal outputted by the CPU 106, the display controller 140 generates a driving signal for driving the display 16 on the basis of the image display command and outputs the generated driving signal to the display 16. Thus, the effect corresponding to the slot game and the outcome thereof is displayed on the display 16.

Therefore, the CPU 106 outputs, to the display controller 140, the image display command for displaying, on the display 16, the slot game image and the effect corresponding to the outcome thereof, at a timing corresponding to the course of the slot game. Thus, the effect corresponding to the slot game and the outcome thereof is displayed on the display 16.

Moreover, in the ROM 108, a correspondence relationship between a code number indicating each of the symbols and one or more random number values belonging to a predetermined numeric range (0 to 255) are stored as weighted data for each of the partitioned regions q11 to q53. For example, regarding a certain symbol, when a plurality of random number values corresponding to the symbol are set, the symbol becomes more likely to be selected compared to the case where only one random number value is set.

Furthermore, in the stop-symbol determination processing in Step S15 shown in FIG. 10, which is performed by the CPU 106 in the slot machine 10 according to the first and second embodiments, the CPU 106 executes a random number generating program to select a random number value from the values "0 to 255" for each of the display regions q11 to q53, and determines a stop-symbol for each of the display regions q11 to q53 by referring to the correspondence between the random number value and the symbol stored in the ROM 108.

Moreover, based on contents of rearrangement of the symbols determined in the stop-symbol determination processing in Step S15, the CPU 106 executes the processing of determining whether or not there is a winning combination on the basis of the symbols rearranged in the partitioned regions q11 to q53 in Step S17 in the slot game processing shown in FIG. 10

The slot machine 10 and playing method thereof according to the third embodiment as described above can also achieve the same effects as those achieved by the slot machine 10 and playing method thereof according to the first embodiment.

Furthermore, although both of the images of the angels 225 and 227 are displayed in the margin around the windows 16*a* to 16*e* on the display 16 used for displaying the slot game in the first to third embodiments described above, the images of the angels 225 and 227 can also be displayed in a location other than on the display 16.

Figure 20:
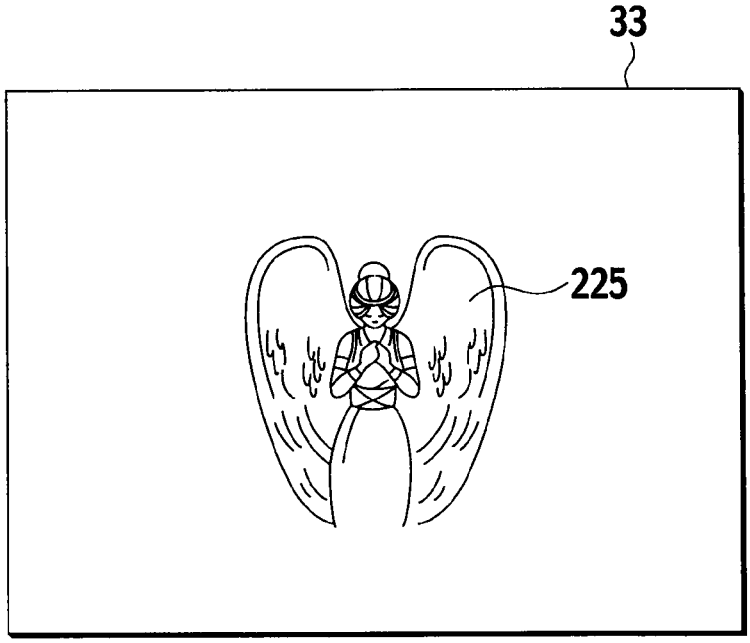
FIG. 20 is an explanatory view showing a display example of an effect in a slot machine according to the fourth embodiment of the present invention.
Figure 21:
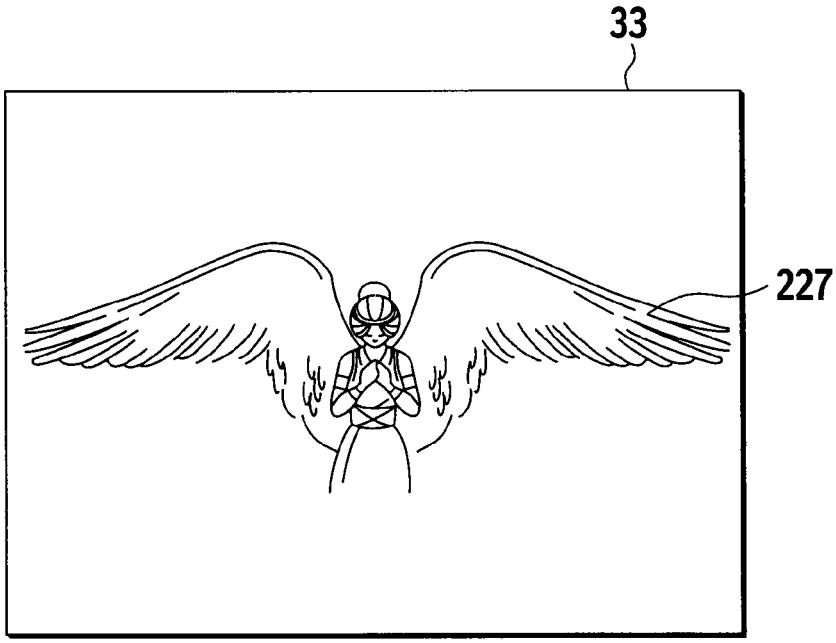
FIG. 21 is an explanatory view showing a display example of an effect in the slot machine according to the fourth embodiment of the present invention.

Hereinafter, description will be given of a slot machine according to a fourth embodiment of the present invention, in which an effect is displayed on a display different from a display used for displaying a slot game, and a playing method thereof FIGS. 20 and 21 are explanatory views showing display examples of effects in the slot machine according to the fourth embodiment of the present invention.

In the slot machine according to the fourth embodiment of the present invention, the images of the angels 225 and 227 are displayed on the upper display 33. Therefore, in the slot machine according to the fourth embodiment, the contents of the effect determined in Step S213 and displayed on the display 16 in Step S215 in FIGS. 11 and 12 by the CPU 106 in the slot machine 10 according to the first embodiment are displayed on the upper display 33 as shown in FIGS. 20 and 21.

The slot machine and playing method thereof according to the fourth embodiment as described above can also achieve the same effects as those achieved by the slot machine 10 and playing method thereof according to the first embodiment.

Note that, also in the slot machine 10 of the third embodiment or the slot machine of the fourth embodiment, it is possible to determine first the total amount of payout to be provided to the player in the free game and then determine the symbol rearrangement pattern in the predetermined number of slot games corresponding to the total number, as in the case of the slot machine according to the first embodiment.

Moreover, also in the slot machine 10 of the third embodiment or the slot machine of the fourth embodiment, it is also possible to determine first the symbol rearrangement pattern in the predetermined number of slot games and then determine the total amount of payout to be provided to the player in the free game according to the determined symbol rearrangement pattern in the predetermined number of slot games, as in the case of the slot machine according to the second embodiment.

Although the slot machine and the method for playing a slot machine according to the present invention have been described above based on the illustrated embodiments, the present invention is not limited thereto. The configurations of the respective parts can be replaced with any configurations having the same functions.

For example, in the above embodiments, the description was given of the case where the display 16 has the fifteen partitioned regions q11 to q53 in the five columns and the three rows. However, any number of the partitioned regions can be arranged in both of the column and row directions in the matrix pattern on the display.

In addition, in the detailed description above, the characteristic portions are mainly described in order to make the present invention easily understandable. The present invention is not limited to the embodiments described in the detailed description above, and can be applied to the other embodiments, and its range of application is wide. Also, the terms and the terminology used in the present specification are used only for the purpose of explaining the present invention precisely, and not used for the purpose of limiting the interpretation of the present invention. Also, for those skilled in the art, it should be easy to contemplate other configurations, systems, methods, etc., that are contained in the concept of the present invention, from the content of the invention described in the present specification. Consequently, the description of the scope of claims should be construed as containing equivalent configurations within a range of not deviating from a range of the technical ideas of the present invention. Also, the purpose of the abstract is to make it possible for the patent office, the general public organizations, and technicians and the like who belong to the present technical field and who are not thoroughly familiar with patent and law terms or specialized terms, to quickly judge the technical content and its essence of the present application by a simple search. Consequently, the abstract is not intended to limit the scope of the invention which should be evaluated by the description of the scope of claims. Also, in order to sufficiently understand the purpose of the present invention and the effects specific to the present invention, they should preferably be interpreted by sufficiently referring to the documents and the like that are already disclosed in public.

Also, the detailed description above contains the processing to be executed by a computer. The explanations and expressions in the above are described for the purpose of facilitating the most efficient understanding by those skilled in the art. In the present specification, each step used in deriving one result should be understood as a processing without a self-contradiction. Also, at each step, transmission and reception, recording, etc., of electric or magnetic signals will be carried out. In the processing at each step, such signals are expressed by bits, values, symbols, letters, terms, numbers, etc., but it should be noted that they are used simply because they are convenient for the purpose of explanation. Also, there are cases where the processing at each step is described by an expression common to the human behavior, but the processing described in the present specification is to be executed by various devices in principle. Also, the other configuration required in carrying out each step will be obvious from the above description.

What is claimed is:

1. A gaming machine comprising:

a display configured to display a unit game causing a plurality of arranged symbols to be rearranged, and to display a special game and an effect, the special game and the effect being started upon satisfaction of a predetermined condition through execution of the unit game, the special game including a plurality of unit games to be executed; and a controller configured to (a) determine whether the predetermined condition is satisfied during executing the unit game, (b) determine a total amount of an award to be provided to a player in the special game by lottery prior to start of the special game upon satisfaction of the predetermined condition, (c) determine symbol rearrangement patterns for generating, during the special game, the determined total amount of the award for the plurality of the unit games by referring to a pattern table after determining the total amount of the award to be provided to the player in the special game and prior to the start of the special game, wherein award amounts of the symbol rearrangement patterns are different from each other and each of the symbol rearrangement patterns is prepared for each of the plurality of the unit games included in the special game, (d) determine contents of the effect to be displayed on the display during the special game, according to the determined total amount of the award after determining the total amount of the award to be provided to the player in the special game and prior to the start of the special game, wherein the contents of the effect is different from the symbol rearrangement patterns representing the result of each unit game in the special game or none-special game, and (e) execute the special game based on the symbol rearrangement patterns as determined for each of the plurality of the unit games and provide the player with each of the award amounts of the determined symbol rearrangement patterns as an award for each of the unit games included in the special game after completing each of the unit games.

2. The gaming machine according to claim 1, wherein the effect announces in advance how much the award to be provided to the player in the special game is, and the controller is configured to determine contents of the effect according to the determined total amount of the award, such that the larger the determined total amount of the award is, the contents announce in advance that the more award is to be provided to the player in the special game.

3. The gaming machine according to claim 1, wherein the display includes:

a first display configured to display the unit game and to display the special game upon satisfaction of the predetermined condition; and a second display configured to display the effect during the special game.

4. The gaming machine according to claim 1, wherein the controller is configured to determine a symbol rearrangement pattern for each of the plurality of the unit games of the special game in reference to a pattern table in which the total amount of the award to be provided for the special game and symbol rearrangement patterns in the plurality of unit games are associated with each other.

5. A gaming machine comprising:

a display configured to display a unit game causing a plurality of arranged symbols to be rearranged, and to display a special game and an effect, the special game and the effect being started upon satisfaction of a predetermined condition through execution of the unit game, the special game including a plurality of unit games to be executed;

a memory configured to store a table associating a total amount of an award to be provided to a player in the special game with contents of the effect to be displayed on the display during the special game; and a controller configured to (a) determine whether the predetermined condition is satisfied during executing the unit game, (b) determine a total amount of an award to be provided to a player in the special game by lottery prior to start of the special game upon satisfaction of the predetermined condition, (c) determine symbol rearrangement patterns for generating, during the special game, the determined total amount of the award for the plurality of the unit games by referring to a pattern table after determining the total amount of the award to be provided to the player in the special game and prior to the start of the special game, wherein award amounts of the symbol rearrangement patterns are different from each other and each of the symbol rearrangement patterns is prepared for each of the plurality of the unit games included in the special game, (d) determine contents of an effect associated with the determined total amount of the award in the table as the contents of the effect to be displayed on the display during the special game, wherein the contents of the effect is different from the symbol rearrangement patterns representing the result of each unit game in the special game or none-special game, and (e) execute the special game based on the symbol rearrangement pattern as determined for each of the plurality of the unit games and provide the player with each of the award amounts of the determined symbol rearrangement patterns as an award for each of the unit games included in the special game after completing each of the unit games.

6. The gaming machine according to claim 5, wherein the effect announces in advance how much the award to be provided to the player in the special game is, and the table associates the total amount of the award with the contents of the effect such that the larger the total amount of the award is, the contents announce in advance that the more award is to be provided to the player in the special game.

7. The gaming machine according to claim 5, wherein the display includes:

a first display configured to display the unit game and to display the special game upon satisfaction of the predetermined condition; and a second display configured to display the effect during the special game.

8. A gaming machine comprising:

a display configured to display a unit game causing a plurality of arranged symbols to be rearranged, and to display a special game and an effect, the special game and the effect being started upon satisfaction of a predetermined condition through execution of the unit game, the special game including a plurality of unit games to be executed; and a controller configured to (a) determine whether the predetermined condition is satisfied during executing the unit game, (b) determine symbol rearrangement patterns for the plurality of the unit games to be displayed on the display as the special game by referring to a pattern table, prior to start of the special game upon satisfaction of the predetermined condition, wherein award amounts of the symbol rearrangement patterns are different from each other and each of the symbol rearrangement patterns is prepared for each of the plurality of the unit games included in the special game, (c) determine contents of the effect to be displayed on the display during the special game prior to the start of the special game, in accordance with a total amount of an award to be generated for the determined symbol rearrangement pattern during the special game, wherein the contents of the effect is different from the symbol rearrangement patterns representing the result of each unit game in the special game or none-special game, and (d) execute the special game based on the symbol rearrangement pattern as determined for each of the plurality of the unit games and provide the player with each of the award amounts of the determined symbol rearrangement patterns as an award for each of the unit games included in the special game after completing each of the unit games.

9. The gaming machine according to claim 8, wherein the effect announces in advance how much the award to be provided to the player in the special game is, and the controller is configured to determine contents of the effect according to the determined total amount of an award, such that the larger the determined total amount of the award is, the contents announce in advance that the more award is to be provided to the player in the special game.

10. The gaming machine according to claim 8, wherein the display includes:

a first display configured to display the unit game and to display the special game upon satisfaction of the predetermined condition are satisfied; and a second display configured to display the effect during the special game.

11. A method for playing a gaming machine configured to display a unit game causing a plurality of arranged symbols to be rearranged on a display and to display a special game and an effect on the display, the special game and the effect being started upon satisfaction of a predetermined condition through execution of the unit game, the special game including a plurality of unit game to be executed, the method comprising:

determining whether the predetermined condition is satisfied during executing the unit game;

determining a total amount of an award to be provided to a player in the special game by lottery prior to start of the special game upon satisfaction of the predetermined condition;

determining symbol rearrangement patterns for generating, during the special game, the determined total amount of the award for the plurality of the unit games by referring to a pattern table after determining the total amount of the award to be provided to the player in the special game and prior to the start of the special game wherein award amounts of the symbol rearrangement patterns are different from each other and each of the symbol rearrangement patterns is prepared for each of the plurality of the unit games included in the special game,;

determining contents of the effect to be displayed on the display during the special game, according to the determined total amount of the award after determining the total amount of the award to be provided to the player in the special game and prior to the start of the special game, wherein the contents of the effect is different from the symbol rearrangement patterns representing the result of each unit game in the special game or none-special game, and executing the special game based on the symbol rearrangement pattern as determined for each of the plurality of the unit games and providing the player with each of the award amounts of the determined symbol rearrangement patterns as an award for each of the unit games included in the special game after completing each of the unit games.

12. The method according to claim 11, wherein the effect announces in advance how much the award to be provided to the player in the special game is, and the step of determining contents of the effect to be displayed on the display during the special game, according to the determined total amount of the award prior to the start of the special game includes:

determining contents of the effect according to the determined total amount of the award, such that the larger the determined total amount of the award is, the contents announce in advance that the more award is to be provided to the player in the special game.

13. The method according to claim 11, wherein the unit game and the special game are displayed on a first display of the display, the effect is displayed on a second display of the display during the special game, and the step of determining contents of the effect, which is displayed on the display during the special game, according to the determined total amount of the award prior to the start of the special game includes:

determining contents of the effect, which is displayed on the second display during the special game, according to the determined total amount of the award prior to the start of the special game.

14. A method for playing a gaming machine configured to display a unit game causing a plurality of arranged symbols to be rearranged on a display and to display a special game and an effect on the display, the special game and the effect being started upon satisfaction of a predetermined condition through execution of the unit game, the special game including a plurality of unit games to be executed, the method comprising:

determining whether the predetermined condition is satisfied during executing the unit game;

determining a total amount of an award to be provided to a player in the special game by lottery prior to start of the special game upon satisfaction of the predetermined condition;

determining symbol rearrangement patterns for generating, during the special game, the determined total amount of the award for the plurality of the unit games by referring to a pattern table after determining the total amount of the award to be provided to the player in the special game and prior to the start of the special game, wherein award amounts of the symbol rearrangement patterns are different from each other and each of the symbol rearrangement patterns is prepared for each of the plurality of the unit games included in the special game;

determining contents of an effect associated with the determined total amount of the award in a table as the contents of the effect to be displayed on the display during the special game, the table associating the total amount of the award to be provided to the player in the special game with contents of the effect to be displayed on the display during the special game, wherein the contents of the effect is different from the symbol rearrangement patterns representing the result of each unit game in the special game or none-special game, and executing the special game based on the symbol rearrangement pattern as determined for each of the plurality of the unit games and providing the player with each of the award amounts of the determined symbol rearrangement patterns as an award for each of the unit games included in the special game after completing each of the unit games.

15. The method according to claim 14, wherein the effect announces in advance how much the award to be provided to the player in the special game is, and the table associates the total amount of the award with the contents of the effect such that the larger the total amount of the award is, the contents announce in advance that the more award is to be provided to the player in the special game.

16. The method according to claim 14, wherein the unit game and the special game are displayed on a first display of the display, the effect is displayed on a second display of the display during the special game, and the step of determining contents of an effect associated with the determined total amount of the award in a table associating the total amount of the award to be provided to the player in the special game with contents of the effect to be displayed on the display during the special game, as the contents of the effect to be displayed on the display during the special game includes:

determining contents of an effect stored in the memory in association with the determined total amount of the award in a table associating the total amount of the award to be provided to the player in the special game with contents of the effect to be displayed on the second display during the special game, as the contents of the effect to be displayed on the second display during the special game.

17. A method for playing a gaming machine configured to display a unit game causing a plurality of arranged symbols to be rearranged on a display and to display a special game and an effect on the display, the special game and the effect being started upon satisfaction of a predetermined condition through execution of the unit game, the special game including a plurality of unit games to be executed, the method comprising:

determining whether the predetermined condition is satisfied during executing the unit game;

determining symbol rearrangement patterns for the plurality of the unit games to be displayed on the display as the special game by referring to a pattern table, prior to start of the special game upon satisfaction of the predetermined condition wherein award amounts of the symbol rearrangement patterns are different from each other and each of the symbol rearrangement patterns is prepared for each of the plurality of the unit games included in the special game;

determining contents of the effect to be displayed on the display during the special game prior to the start of the special game, in accordance with a total amount of an award to be generated when the predetermined number of unit games are displayed on the display along with the determined symbol rearrangement pattern during the special game, wherein the contents of the effect is different from the symbol rearrangement patterns representing the result of each unit game in the special game or none-special game, and executing the special game based on the symbol rearrangement pattern as determined for each of the plurality of the unit games and providing the player with each of the award amounts of the determined symbol rearrangement patterns as an award for each of the unit games included in the special game after completing each of the unit games.

18. The method according to claim 17, wherein the effect announces in advance how much the award to be provided to the player in the special game is, and the step of determining contents of the effect to be displayed on the display during the special game prior to the start of the special game, in accordance with a total amount of an award to be generated when the plurality of unit games are displayed on the display along with the determined symbol rearrangement pattern during the special game includes:

determining contents of the effect according to the determined total amount of the award, such that the larger the determined total amount of the award is, the contents announce in advance that the more award is to be provided to the player in the special game.

19. The method according to claim 17, wherein the unit game and the special game are displayed on a first display of the display, the effect is displayed on a second display of the display during the special game, the step of determining a symbol rearrangement pattern for each of the plurality of the unit games to be displayed on the display as the special game, prior to start of the special game upon satisfaction of the predetermined condition includes:

determining a symbol rearrangement pattern for each of the plurality of the unit games to be displayed on the first display as the special game, prior to start of the special game upon satisfaction of the predetermined condition, and the step of determining contents of the effect to be displayed on the display during the special game prior to the start of the special game, in accordance with a total amount of an award to be generated when the plurality of unit games are displayed on the display along with the determined symbol rearrangement pattern during the special game includes:

determining contents of the effect to be displayed on the second display during the special game prior to the start of the special game, in accordance with a total amount of an award to be generated when the plurality of unit games are displayed on the first display along with the determined symbol rearrangement pattern during the special game.

20. A gaming machine comprising:

a display configured to display a unit game causing a plurality of arranged symbols to be rearranged, and to display a special game and an effect upon satisfaction of a predetermined condition, the special game including a plurality of unit games to be executed; and a controller configured to (a) determine whether the predetermined condition is satisfied during executing the unit game, (b) determine a total amount of an award to be provided to a player in the special game by lottery prior to start of the special game upon satisfaction of the predetermined condition, the total amount of the award being a final amount to be provided to the player for the special game regardless of a manner of play by the player in the special game, (c) determine symbol rearrangement patterns for generating, during the special game, the determined total amount of the award for the plurality of the unit games by referring to a pattern table after determining the total amount of the award to be provided to the player in the special game and prior to the start of the special game, wherein award amounts of the symbol rearrangement patterns are different from each other and each of the symbol rearrangement patterns is prepared for each of the plurality of the unit games included in the special game, (d) determine contents of the effect to be displayed on the display during the special game, according to the determined total amount of the award after determining the total amount of the award to be provided to the player in the special game and prior to the start of the special game, wherein the contents of the effect is different from the symbol rearrangement patterns representing the result of each unit game in the special game or none-special game, and (e) provide the player with each of the award amounts of the determined symbol rearrangement patterns as an award for each of the unit games included in the special game after completing each of the unit games.

* * * * *